US010581184B2

(12) United States Patent
Tsukashima et al.

(10) Patent No.: US 10,581,184 B2
(45) Date of Patent: Mar. 3, 2020

(54) LOW-PROFILE BOARD-TO-BOARD CONNECTOR, MATING CONNECTOR, AND CONNECTOR ASSEMBLY

(71) Applicant: Molex, LLC, Lisle, IL (US)

(72) Inventors: Shiro Tsukashima, Yamato (JP); Daiki Tanaka, Yamato (JP); Naoto Yoshikawa, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/252,143

(22) Filed: Jan. 18, 2019

(65) Prior Publication Data

US 2019/0229447 A1 Jul. 25, 2019

Related U.S. Application Data

(60) Provisional application No. 62/619,251, filed on Jan. 19, 2018.

(30) Foreign Application Priority Data

Feb. 27, 2018 (JP) ..... 2018-033079

(51) Int. Cl.

| | |
|---|---|
| ***H01R 12/71*** | (2011.01) |
| ***H01R 12/57*** | (2011.01) |
| ***H01R 12/73*** | (2011.01) |
| ***H01R 13/115*** | (2006.01) |
| ***H01R 13/629*** | (2006.01) |
| ***H01R 13/405*** | (2006.01) |
| ***H01R 13/20*** | (2006.01) |
| ***H01R 12/89*** | (2011.01) |
| *H01R 12/79* | (2011.01) |

(Continued)

(52) U.S. Cl.

CPC ..... *H01R 12/57* (2013.01); *H01R 12/716* (2013.01); *H01R 12/73* (2013.01); *H01R 12/89* (2013.01); *H01R 13/115* (2013.01); *H01R 13/20* (2013.01); *H01R 13/405* (2013.01); *H01R 13/629* (2013.01); *H01R 12/00* (2013.01); *H01R 12/52* (2013.01); *H01R 12/79* (2013.01)

(58) Field of Classification Search

CPC ..... H01R 12/00; H01R 12/52; H01R 12/716
USPC ..... 439/74
See application file for complete search history.

(56) References Cited

U.S. PATENT DOCUMENTS

| | | | | |
|---|---|---|---|---|
| 7,922,499 | B2 * | 4/2011 | Liao | H01R 12/714 439/660 |
| 8,083,527 | B2 * | 12/2011 | Takeuchi | H01R 13/26 439/65 |
| 2015/0140840 | A1 * | 5/2015 | Nishimura | H01R 12/79 439/74 |

FOREIGN PATENT DOCUMENTS

| | | | |
|---|---|---|---|
| JP | 2014-137989 | A | 7/2014 |

* cited by examiner

*Primary Examiner* — Abdullah A Riyami
*Assistant Examiner* — Justin M Kratt
(74) *Attorney, Agent, or Firm* — Molex, LLC

(57) ABSTRACT

A connector includes a housing and terminals held by the housing, the housing includes flat plate-like terminal holding portions and contact portion storage opening opened to lower faces of the terminal holding portions. The terminals each have a main body, a U-shaped contact portion that is connected to a front end of the main body and protrudes downward, and a tip portion connected to a front end of the contact portion. The contact portion includes a pair of leg portions extending downward, and a bottom portion coupling lower ends of the leg portions to each other. The main (Continued)

body and the tip portion are integrally connected and held by the terminal holding portions, and the contact portion is stored in the contact portion storage opening.

8 Claims, 28 Drawing Sheets

(51) Int. Cl.
*H01R 12/00* (2006.01)
*H01R 12/52* (2011.01)

FIG. 2D
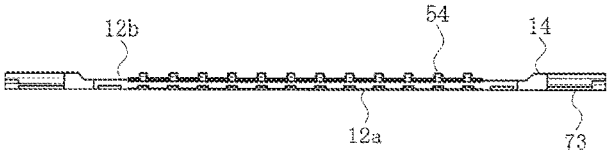
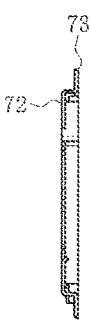
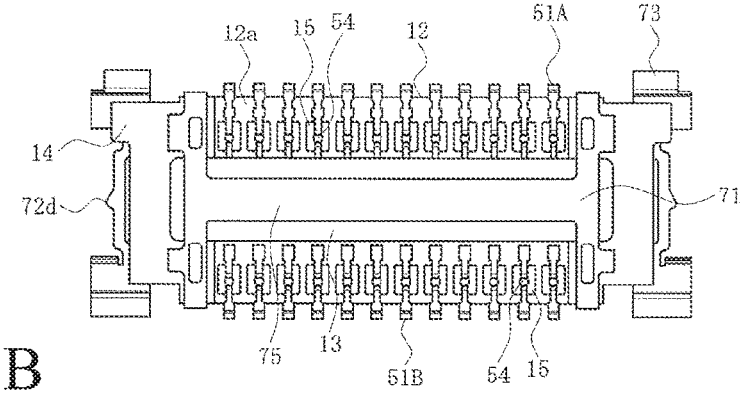
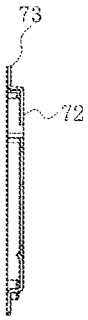
FIG. 2B
FIG. 2A
FIG. 2C
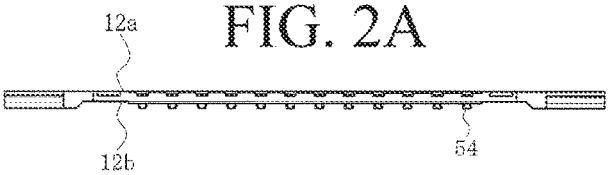
FIG. 2E
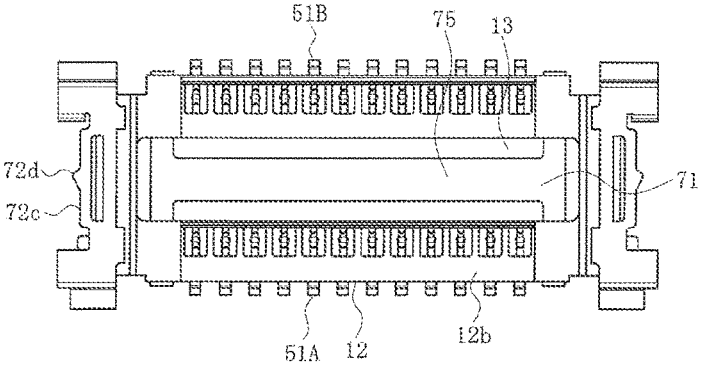
FIG. 2F FIG. 6A
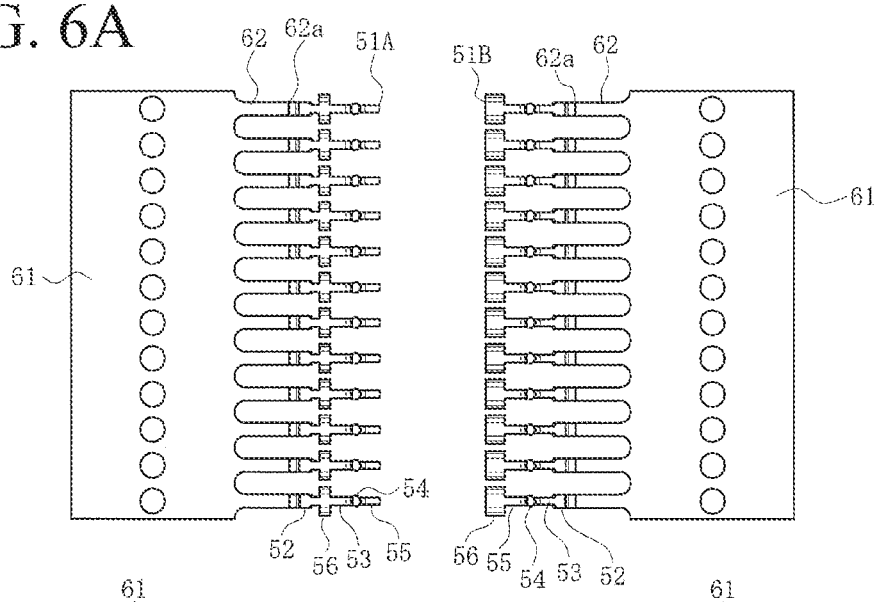
FIG. 6B
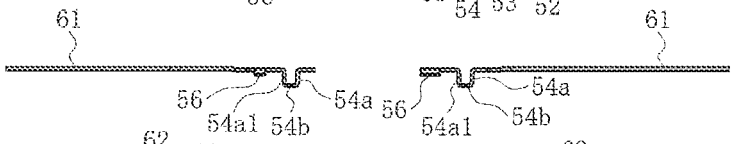
FIG. 6C
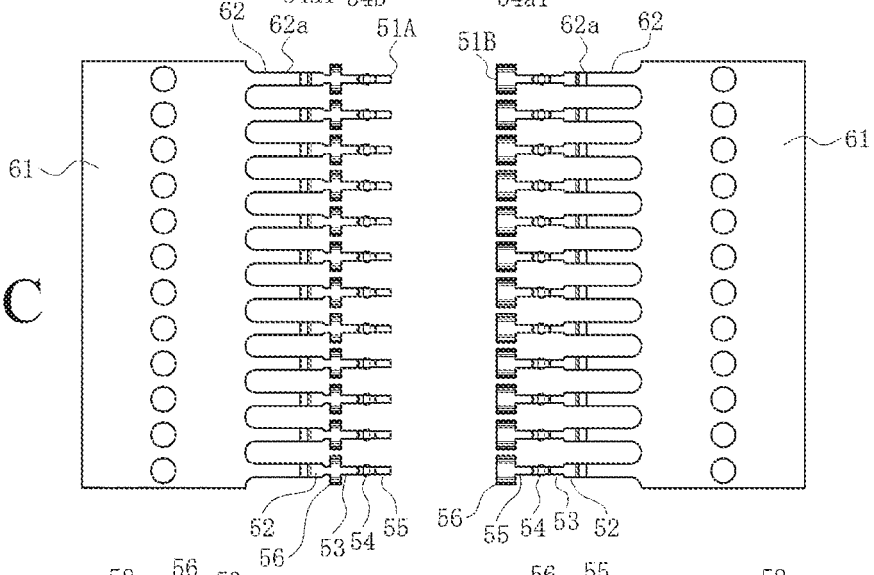
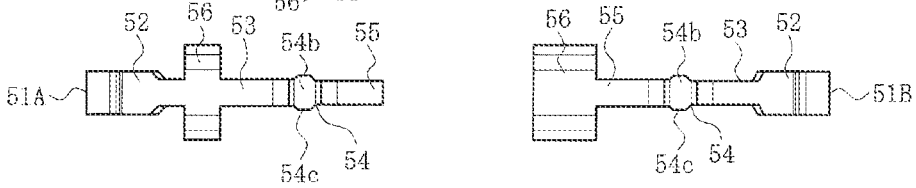
FIG. 6D FIG. 8D
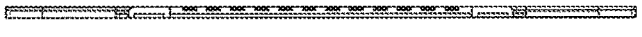
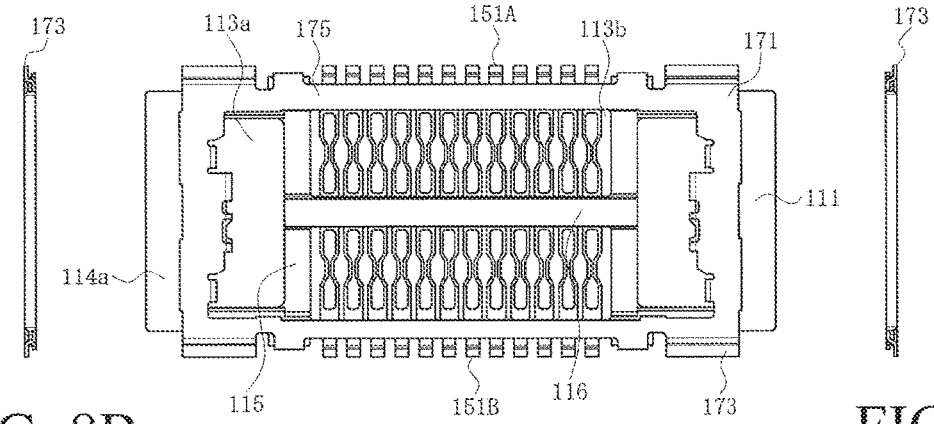
FIG. 8B FIG. 8A FIG. 8C
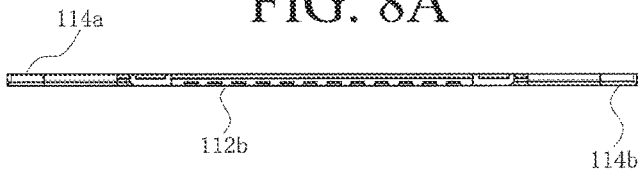
FIG. 8E
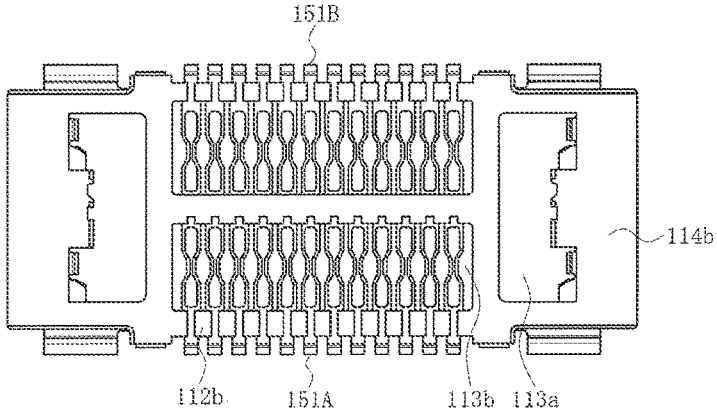
FIG. 8F

LOW-PROFILE BOARD-TO-BOARD CONNECTOR, MATING CONNECTOR, AND CONNECTOR ASSEMBLY

RELATED APPLICATIONS

This application claims priority to U.S. Application No. 62/619,251, filed Jan. 19, 2018 and to Japanese Application No. 2018-033079, filed Feb. 27, 2018, both of which are incorporated herein by reference in their entireties.

TECHNICAL FIELD

The present disclosure relates to a connector, a mating connector, and a connector assembly.

BACKGROUND ART

In the related art, connectors such as board to board connectors, etc., have been used to electrically connect pairs of parallel circuit boards together. Such connectors are attached to respective opposed faces of a pair of circuit boards and are engaged with each other, mated so as to be electrically connected to each other. To meet a demand for reduction in profile, each connector is shaped like a thin plate. A terminal of one connector has a pin-like protruding portion protruding toward a mating connector. (See, for example, Patent Document 1).

FIGS. 28A and 28B are views of a known connector when viewed from two directions. FIG. 28A is a plan view and FIG. 28B is a side view.

In the figures, 811 denotes a housing of a connector mounted on a circuit board not illustrated, and the housing has a flat bottom plate 812. Terminals 851 are elongated plate-like terminals extending in the width direction of the housing 811, and a pin-like protruding portion 853 protruding upward is formed on the upper face of each terminal 851. The terminals 851 are embedded in the bottom plate 812 of the housing 811 by insert-molding. The bottom plate 812 has rectangular holes 813, and the protruding portions 853 of the terminals 851 are located in the rectangular holes 813.

When the connector engages with the mating connector not illustrated, the protruding portions 853 of the terminals 851 are inserted into respective insertion holes of mating terminals and make contact therewith. As a result, the terminals 851 are electrically connected to the mating terminals.

Patent Document 1: JP 2014-137989 A

SUMMARY

However, in the known connector, the pin-like protruding portions 853 protruding upward from the upper faces of the terminals 851 are inserted into the respective insertion holes of the mating terminals and thus, the terminals 851 cannot engage with the mating terminals. For this reason, when an external force to release the engagement of the connector with the mating connector is applied, the protruding portions 853 easily escape from the respective insertion hole, such that the terminals 851 easily separate from the mating terminals to disconnect the connection between the terminals 851 and the mating terminals. Since the terminals 851 are separated from the mating terminals, engagement of the connector with the mating connector is readily released.

An object of this disclosure is to solve the problem of the known connector, and provide reliable connector, mating connector, and connector assembly that engage a terminal with a mating terminal, reliably keep the contact state of the terminal and the mating terminal, and reliably keep engagement of the connector with the mating connector.

Thus, a connector includes a housing and a terminal held by the housing. The housing includes a flat plate-like terminal holding portion and a contact portion storage opening opened in a lower face of the terminal holding portion. The terminal includes a main body, a U-shaped contact portion that is connected to a front end of the main body and protrudes downward, and a tip portion connected to a front end of the contact portion. The contact portion includes a pair of leg portions extending downward and a bottom portion coupling lower ends of the leg portions to each other. The main body and the tip portion are integrally connected to the terminal holding portion and held by the terminal holding portion. The contact portion is stored in the contact portion storage opening.

In another connector, the terminal is formed of a metal plates bent in a thickness direction.

In still another connector, the leg portions of the terminal make contact with a mating terminal.

In still another connector, one leg portion in the pair is wider than the other leg portion to form a main contact portion.

In still another connector, the bottom portion includes engagement projections protruding from both left and right sides outward in a width direction.

In still another connector, the bottom portion further protrudes below a lower face of the terminal holding portion.

A mating connector is a mating connector that is engageable with the connector of the present disclosure. The mating connector includes a mating housing and a mating terminal held by the mating housing. The mating housing includes a flat plate-like mating terminal holding portion and a terminal storage opening. The mating terminal includes a main body, a contact portion that is connected to a front end of the main body and has a contact opening penetrating the mating terminal in a thickness direction, and a tip portion connected to a front end of the contact portion. The main body and the tip portion are integrally connected to the mating terminal holding portion and held by the mating terminal holding portion. The contact portion is stored in the terminal storage opening. When the mating connector engages with the connector, a pair of opening arm portions located on both sides of the contact opening clamp the leg portions.

A connector assembly includes the connector of the present disclosure, and a mating connector that is engageable with the connector.

According to the present disclosure, the terminal engages with the mating terminal, the contact state of the terminal and the mating terminal is reliably kept, and the engagement of the connector with the mating connector is reliably kept to improve reliability.

BRIEF DESCRIPTION OF THE DRAWINGS

FIG. 1A is a perspective view when viewed from above, and FIG. 1B is a perspective view when viewed from below.

FIGS. 2A to 2F are views of the plug connector in this embodiment when viewed from six directions, FIG. 2A is a top view, FIGS. 2B and 2C are end views, FIGS. 2D and 2E are side views, and FIG. 2F is a bottom view.

FIG. 4A is a perspective view when viewed from above, and FIG. 4B is a perspective view when viewed from below.

FIG. 5A is a perspective view of the signal pins connected to the carrier when viewed from below, and FIG. 5B is a perspective view of the signal pins connected to the carrier when viewed from above.

FIGS. 6A to 6D are views of the signal pins in this embodiment when viewed from four directions, FIG. 6A is a top view of the signal pins connected to the carrier, FIG. 6B is a side view of the signal pins connected to the carrier, FIG. 6C is a bottom view of the signal pins connected to the carrier, and FIG. 6D is an enlarged top view of the signal pins cut from the carrier.

FIGS. 8A to 8F are views of the receptacle connector in this embodiment when viewed from six directions. FIG. 8A is a top view, FIGS. 8B and 8C are end views, FIGS. 8D and 8E are side views, and FIG. 8F is a bottom view.

FIG. 10A is a perspective view when viewed from above, and FIG. 10B is a perspective view when viewed from below.

FIG. 11A is a perspective view of terminals connected to a carrier when viewed from above, and FIG. 11B is a perspective view of the terminals connected to the carrier when viewed from below.

FIG. 12A is a top view of the terminals connected to the carrier, FIG. 12B is a side view of the terminals connected to the carrier, and FIG. 12C is a bottom view of the terminals connected to the carrier.

FIG. 15A is a top view, FIG. 15C is a bottom view.

FIG. 17A is a top view, and FIG. 17B is an end view.

FIG. 20A is a top view, FIG. 20B is a side view, and FIG. 20C is a bottom view.

FIG. 22A is a top view, and FIG. 22B is an end view.

FIG. 25A is a top view, FIG. 25B is a side view, and FIG. 25C is a bottom view.

FIGS. 26A to 26C are views illustrating the first to third steps of engagement.

FIG. 27A is a top view illustrating the second step of engagement, FIG. 27B is a perspective view illustrating the second step of engagement, FIG. 27C is a top view illustrating the third step of engagement, and FIG. 27D is a perspective view illustrating the third step of engagement.

FIG. 28A is a plan view, and FIG. 28B is a side view.

DETAILED DESCRIPTION OF THE PREFERRED EMBODIMENTS

Embodiments will be described in detail below with reference to drawings.

Figure 1B:
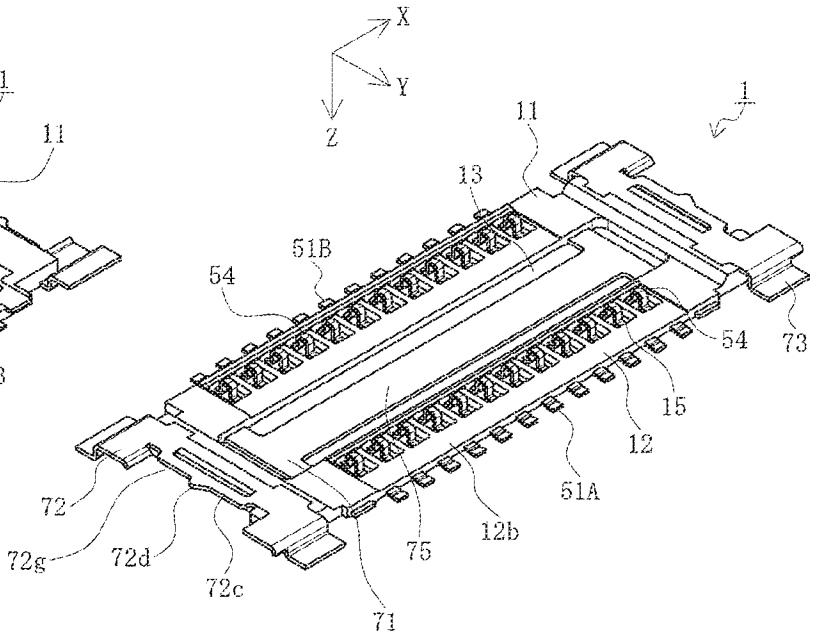
FIGS. 1A and 1B are perspective views of a plug connector in this embodiment.
Figure 1A:
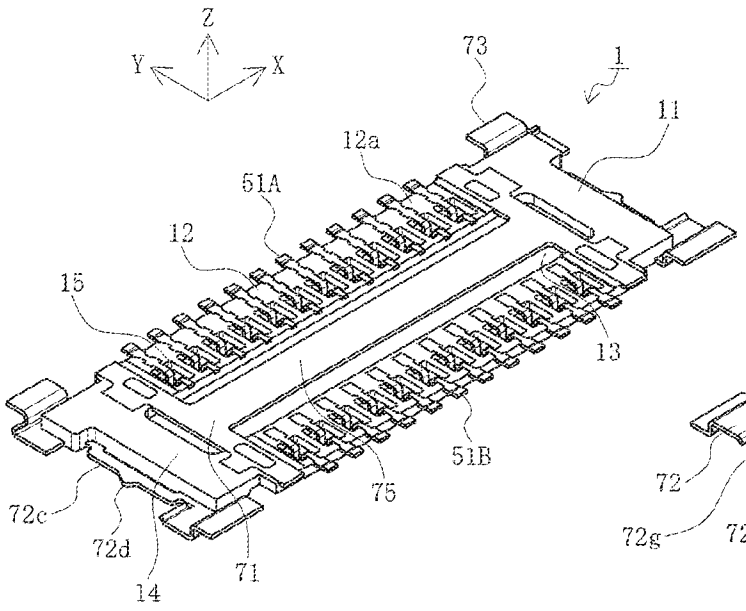
Figure 3:
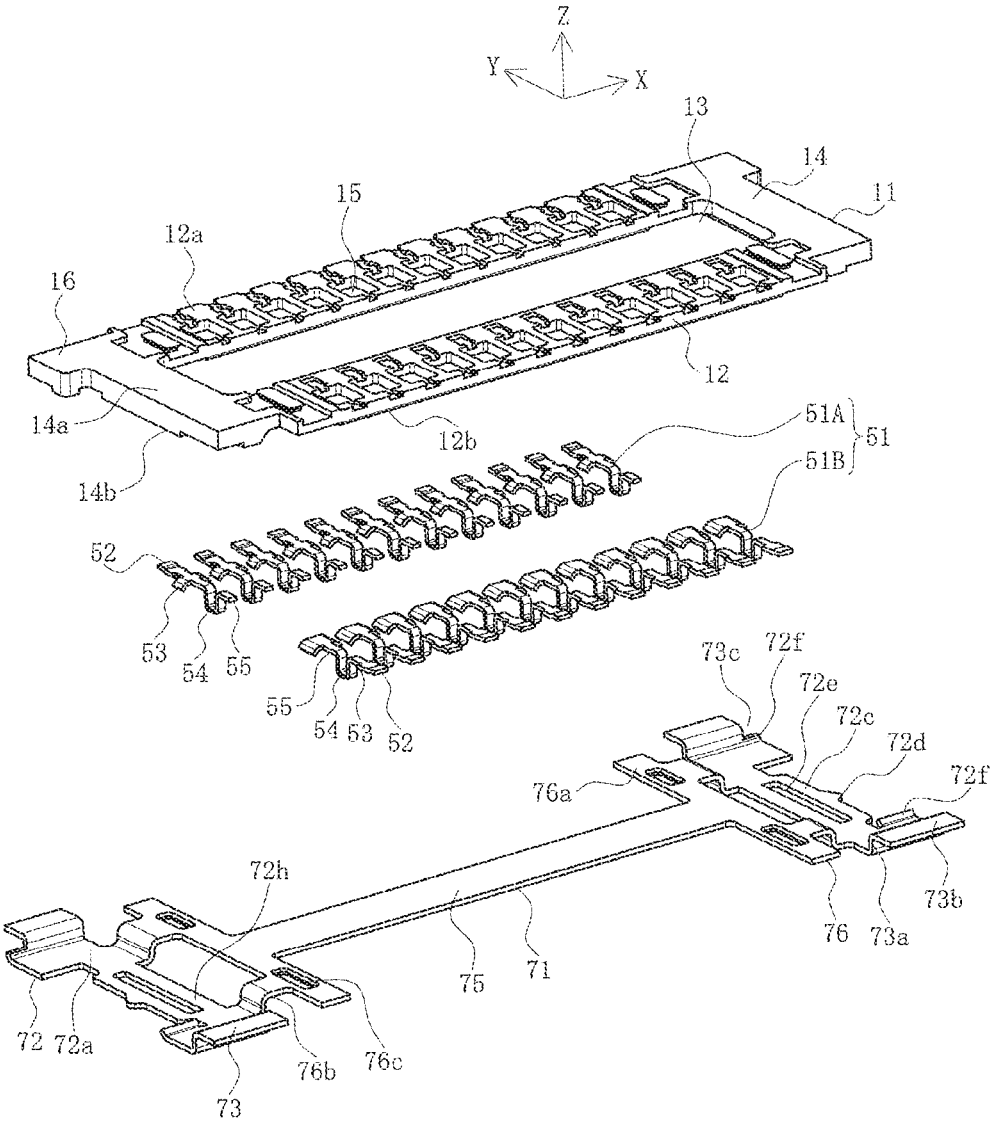
FIG. 3 is an exploded view of the plug connector in this embodiment.
Figures 4A, 4B:
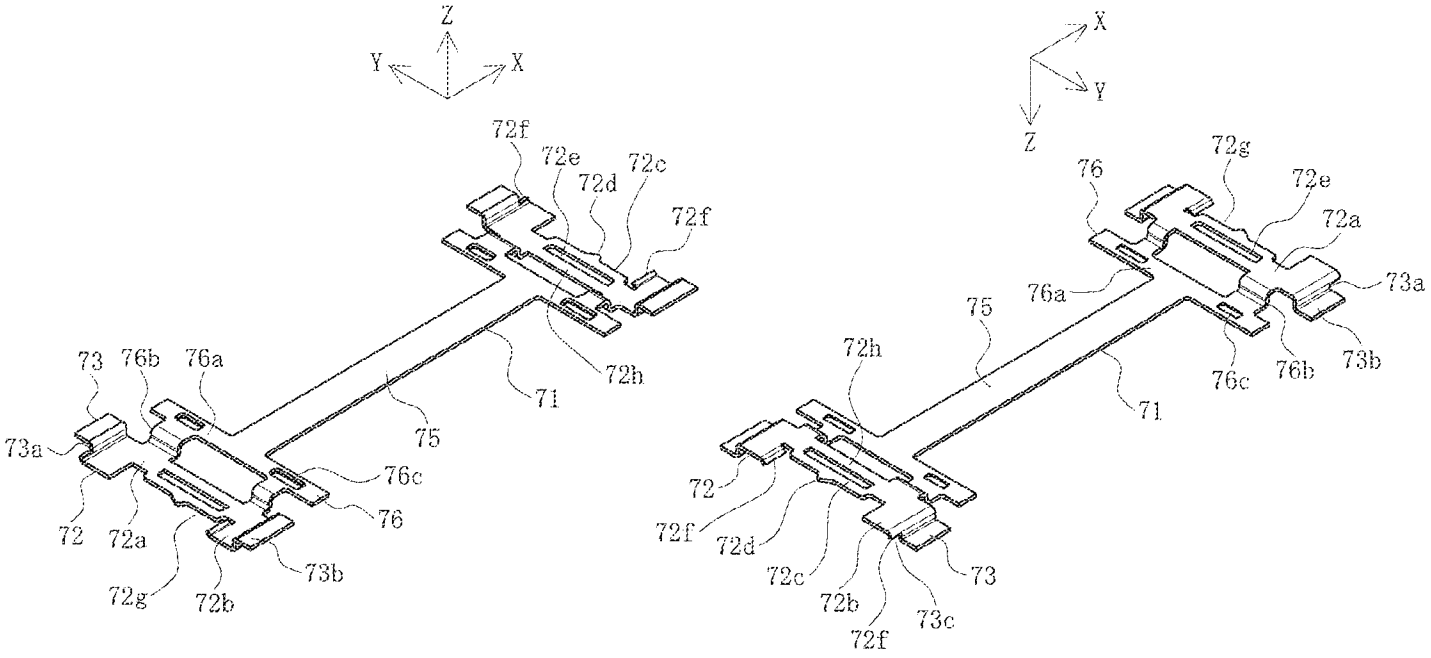
FIGS. 4A and 4B are perspective views of a plug shell in this embodiment.
Figure 5A:
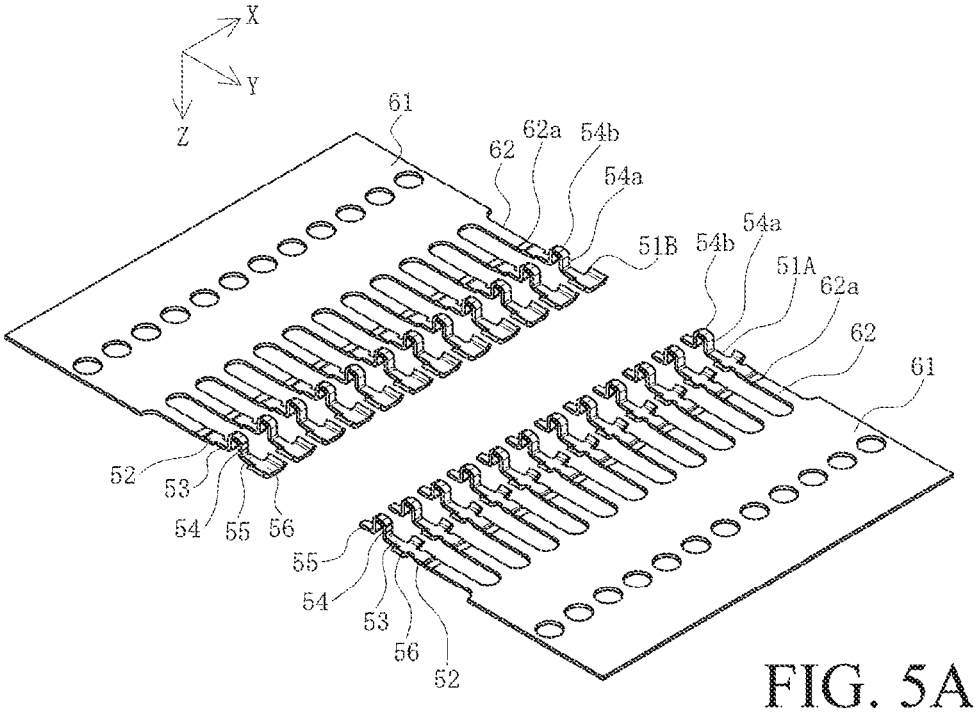
FIGS. 5A and 5B are perspective views of signal pins in this embodiment.
Figure 5B:
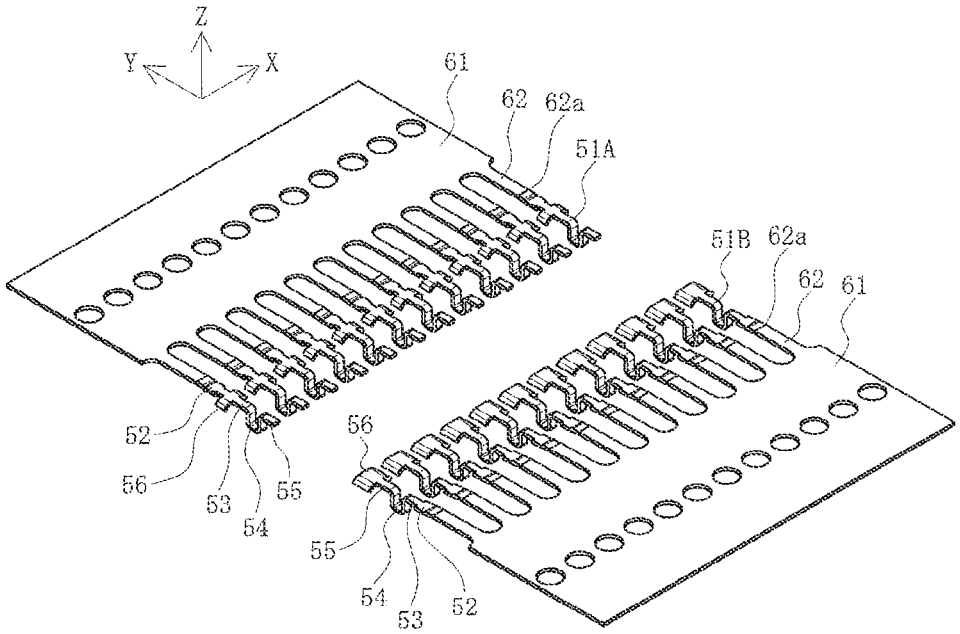

FIGS. 1A and 1B are perspective views of a plug connector in this embodiment, FIGS. 2A to 2F are views of the plug connector in this embodiment when viewed from six directions, FIG. 3 is an exploded view of the plug connector in this embodiment, FIGS. 4A and 4B are perspective views of a plug shell in this embodiment, FIGS. 5A and 5B are perspective views of signal pins in this embodiment, and FIGS. 6A to 6D are views of the signal pins in this embodiment when viewed from four directions. FIGS. 1A and 4A are perspective view when viewed from above, FIGS. 1B and 4B are perspective views when viewed from below, FIG. 2A is a top view, FIGS. 2B and 2C are end views, FIGS. 2D and 2E are side views, FIG. 2F is a bottom view, FIG. 5A is a perspective view of the signal pins connected to a carrier when viewed from below, FIG. 5B is a perspective view of the signal pins connected to the carrier when viewed from above, FIG. 6A is a top view of the signal pins connected to the carrier, FIG. 6B is a side view of the signal pins connected to the carrier, FIG. 6C is a bottom view of the signal pins connected to the carrier, and FIG. 6D is an enlarged top view of the signal pins cut from the carrier.

In the drawings, 1 denotes the plug connector that is the connector in this embodiment. The plug connector 1 is a surface mounting-type flat plate-like connector that has a substantially rectangular flat plane and is mounted on the surface of a below-mentioned first substrate 91, and is electrically connected to a receptacle connector 101 that is a below-mentioned mating connector. The receptacle connector 101 is also a surface mounting-type connector mounted on the surface of a below-mentioned second substrate 191. In this embodiment, the plug connector 1 is engageable with the receptacle connector 101. They constitute a connector assembly in this embodiment, and electrically connect the first substrate 91 to the second substrate 191. Examples of the first substrate 91 and the second substrate 191 include printed circuit boards, flexible flat cables (FFC), flexible printed circuit boards (FPC), etc. used in electronic equipment, etc., but may be any type of substrate.

Furthermore, expressions for indicating directions such as up, down, left, right, front, and back, used to describe the operations and configurations of the parts of the plug connector 1 and the receptacle connector 101 in this embodiment are not absolute but rather relative directions, and though appropriate when the parts of plug connector 1 and receptacle connector 101 are in the positions illustrated in the figures, these directions should be interpreted differently when these positions change, to correspond to said change.

The plug connector 1 includes a housing 11 made of an insulating material such as resin, a signal pins 51 that are terminals made of a conductive material such as copper alloy, and a plug shell 71 that is an enforcing fixture made of a metal having a high strength such as steel. The signal pins 51 are disposed so as to form a plurality of (two in the illustrated example) lines extending in the longitudinal direction (X-axis direction) of the housing 11. The housing 11 is a member formed by integrating the signal pins 51 and the plug shell 71 by insert molding and thus, is not present as a single piece in fact. However, in FIG. 3 and other figures, for convenience of description, the housing is drawn as an independent member. When engaging with the receptacle connector 101, the plug connector 1 slides with respect to the receptacle connector 101 in a left upward direction (Y-axis positive direction) in FIG. 1A.

As illustrated in FIG. 3, the housing 11 is a flat plate-like frame member having a substantially rectangular flat face, and has lengthwise frame portions 12 that are a pair of terminal holding portions extending in the longitudinal direction and a pair of crosswise frame portions 14 that couple both ends of the lengthwise frame portions 12 to each other and extend in the width direction (Y-axis direction). A central opening 13 is formed at the center of the housing. The central opening is shaped like a substantially rectangle defined by the lengthwise frame portions 12 and the crosswise frame portions 14, and penetrates the housing in the thickness direction, that is, the vertical direction (Z-axis direction). Each of the lengthwise frame portions 12 has at least a contact portion storage opening 15 in a lower face 12*b* that is an engagement face. In the illustrated example, the plurality of contact portion storage openings 15 penetrating in the vertical direction are formed in each of the lengthwise frame portions 12 so as to form a line in the longitudinal direction. Each of the contact portion storage opening 15 stores a signal contact portion 54 of the signal pin 51. A convex portion 16 protruding outward in the longitudinal direction is formed at the coupling part between the lengthwise frame portion 12 and the crosswise frame portion 14 on the front side in the slide direction (on the side in the Y-axis positive direction).

The signal pins 51 include first signal pins 51A that are front terminals attached to the lengthwise frame portion 12 on the front side in the slide direction and second signal pins 51B that are rear terminals attached to the lengthwise frame portion 12 on the rear side in the slide direction. When describing the first signal pins 51A and the second signal pins 51B together, the first signal pins 51A and the second signal pins 51B are described as the signal pins 51. The signal pins 51 each are a member formed of a metal plate bent in the thickness direction, and is produced by punching or bending the metal plate. As illustrated in FIGS. 5A and 5B and 6A to 6C, the plurality of signal pins are connected to a flat plate-like carrier 61. Each of the signal pin 51 is connected to the carrier 61 via an elongated connection arm 62, and is separated from the connection arm 62 by cutting at a cutting portion 62*a* to form a member as illustrated in FIG. 3 and FIG. 6D.

Each of the signal pins 51 has a main body 53, a connecting portion 52 that is a tail portion connected to a rear end (end on the side of the carrier 61) of the main body 53, a signal contact portion 54 that is a contact portion connected to a front end (end away from the carrier 61) connected to the main body 53, and a tip portion 55 connected to a front end of the signal contact portion 54, and the main body 53 and the tip portion 55 are integrally connected to the lengthwise frame portion 12 and held by the lengthwise frame portion 12. The connecting portion 52 is a conductive portion connected to a connection pad or the like exposed on the surface of the first substrate 91 by use of connection means such as soldering. The signal contact portion 54 is a conductive portion that is in contact with a below-mentioned terminal 151 of the receptacle connector 101. As illustrated in FIG. 6B, when viewed from side, the main body 53, the connecting portion 52, and the tip portion 55 are flat members and are substantially flush with one another, and the signal contact portion 54 is a U-shaped portion protruding downward (Z-axis negative direction). Describing in detail, the signal contact portion 54 includes a pair of leg portions 54*a* that extend downward, a flat plate-like bottom portion 54*b* that couples lower ends of the leg portions 54*a* to each other, and projections 54*c* that are engagement projections protruding from both left and right sides of the bottom portion 54*b* outward in the width direction (X-axis direction). As illustrated in FIG. 6D, the main body 53, the tip portion 55, and the leg portions 54*a* and the bottom portion 54*b* of the signal contact portion 54 are planar members having the substantially same width, and the projections 54*c* protrudes outward from the width of the bottom portion 54*b*. Describing in detail, out of the pair of leg portions 54*a*, the leg portion 54*a* located on the front side in the slide direction, as a main contact portion 54*a*1, is wider than the leg portion 54*a* located on the rear side in the slide direction. In the middle of the main body 53 of the first signal pin 51A and at the tip of the tip portion 55 of the second signal pin 51B, a wide portion 56 is formed as a plate piece holding portion. The wide portion extends from both left and right sides outward in the width direction, and is curved downward at a tip. That is, the signal pin 51 has the wide portion 56 formed relatively near the main contact portion 54*a*1 on the front side in the slide direction.

The signal pin 51 is integrated with the lengthwise frame portion 12 such that the main body 53, the connecting portion 52, and at least a part of the upper face of the tip portion 55 are exposed on an upper face 12*a* of a mounting face (non-engagement face) of the lengthwise frame portion 12, the signal contact portion 54 is stored in the contact portion storage opening 15, and at least a tip of the connecting portion 52 protrudes toward the outer end of the lengthwise frame portion 12. Since the first signal pin 51A is attached to the lengthwise frame portion 12 on the front side in the slide direction (Y-axis positive direction), the tip of the connecting portion 52 protrudes further than the end of the lengthwise frame portion 12 on the front side in the slide direction to the front side in the slide direction, and since the second signal pin 51B is attached to the lengthwise frame portion 12 on the rear side in the slide direction (on the side in the Y-axis negative direction), a tip of the connecting portion 52 protrudes further than the end of lengthwise frame portions 12 on the rear side in the slide direction to the rear side in the slide direction. The bottom portion 54*b* located at a lower end of the signal contact portion 54 protrude below the lower face 12*b* that is the engagement face (non-mounting face) of the lengthwise frame portions 12. The wide portion 56 is integrated with the lengthwise frame portion 12 nearer the main contact portion 54*a*1 than the signal contact portion 54 on the front side in the slide direction, and its tip bent downward penetrates into the lengthwise frame portion 12.

The plug shell 71 is a member produced by punching, bending, or any other suitable processing of a metal plate, and as illustrated in FIGS. 3 to 4B, has an elongated band-like coupling portion 75 that extends is an longitudinal direction (X-axis direction) and serves as a central support portion, a pair of support plate portions 76 connected to both ends of the coupling portion 75, a pair of lock portions 72 connected to the outer side of the support plate portions 76 in the longitudinal direction, a pair of substrate connecting portions 73 connected to each of the lock portions 72.

The support plate portions 76 each have a flat plate-like main body 76*a*, a central portion of which is connected to the coupling portion 75, extending in the width direction (Y-axis direction), and a pair of connecting plates 76*b* extending from vicinities of both widthwise ends of the main body 76*a* outward in the longitudinal direction. The connecting plates 76*b* each are a crank-like member when viewed from side, and the lock portions 72 connected to the tips of the connecting plates 76*b* each are located substantially parallel to the coupling portion 75 and the main body 76*a* of the support plate portion 76, and below the coupling portion 75 and the main body 76*a* of the support plate portion 76. The main body 76*a* has an opening 76*c*. In the illustrated example, one coupling portion 75 and two connecting plates 76*b* are provided. However, the number of the coupling portion 75 and the connecting plates 76*b* may be limited to this, and may be any number. That is, any number of the coupling portion 75 and the connecting plates 76*b* may be provided in any place, for example, the outermost side in the width direction, as long as they function as bridging members to keep the distance between the lock portions 72 at both ends.

The lock portion 72 has a flat plate-like lock main body 72*a* that is connected to a tip of the connecting plate 76*b* and extends in the width direction, a pair of arm portions 72*b* that extends from both ends of the lock main body 72*a* outward in the longitudinal direction, a flat plate-like lock spring piece 72*c* that has both ends connected to the lock main body 72*a* and extends in the width direction, and a lock projection 72*d* that extends from the center of the lock spring piece 72*c* in the width direction outward in the longitudinal direction. The lock projection 72*d* is formed such that a front inclined face has a smaller inclination than a rear inclined face. The lock main body 72*a* has an opening 72*e* located in the rear of the lock spring piece 72*c*, and the lock spring piece 72*c* is opposed to a bottom plate 72*h* across the opening 72*e*. The opening 72*e* is a space for allowing a deflection of the lock spring piece 72*c*. The outer side of the lock spring piece 72*c* in the longitudinal direction constitutes a concave space 72*g* defined in three directions by the lock spring piece 72*c* and the pair of arm portions 72*b*. An end of the arm portions 72*b* on the front side in the slide direction has a curved portion 72*f* having an upwardly-curved tip.

The substrate connecting portion 73 has a crank-like intermediate portion 73*a* when viewed from side, which is connected to an outer end of the arm portion 72*b* of the lock portion 72, and a flat plate-like connecting plate portion 73*b* connected to a tip of the intermediate portion 73*a*. The connecting plate portion 73*b* is substantially flush with the coupling portion 75 and the main body 76*a* of the support plate portions 76. The substrate connecting portion 73 on the front side in the slide direction includes the intermediate portion 73*a* and a notch portion 73*c* formed by cutting a part of the connecting plate portion 73*b*, and the curved portion 72*f* is formed at the end of the arm portion 72*b* corresponding to the notch portion 73*c* on the front side in the slide direction.

In the plug shell 71, the upper face in the vicinity of both ends of the main body 76*a* of the support plate portion 76 in the width direction is exposed on the upper face 12*a* and an upper face 14*a* that are mounting faces of the lengthwise frame portion 12 and the crosswise frame portions 14, the lower face of the lock portions 72 is exposed on a lower face 14*b* that is the engagement face of the crosswise frame portion 14, and the coupling portion 75 is integrated with the housing 11 so as to be stored in the central opening 13. The connecting plate portion 73*b* of the substrate connecting portions 73 is located on the outer side of the outer end of the crosswise frame portion 14 in the width direction (Y-axis direction), and its upper face is substantially flush with the upper face of the connecting portion 52 of the signal pin 51. The lock spring piece 72*c* of the lock portions 72 is located on the outer side of the outer end of the crosswise frame portion 14 in the longitudinal direction (X-axis direction).

Next, the configuration of a receptacle connector 101 will be described.

Figure 7:
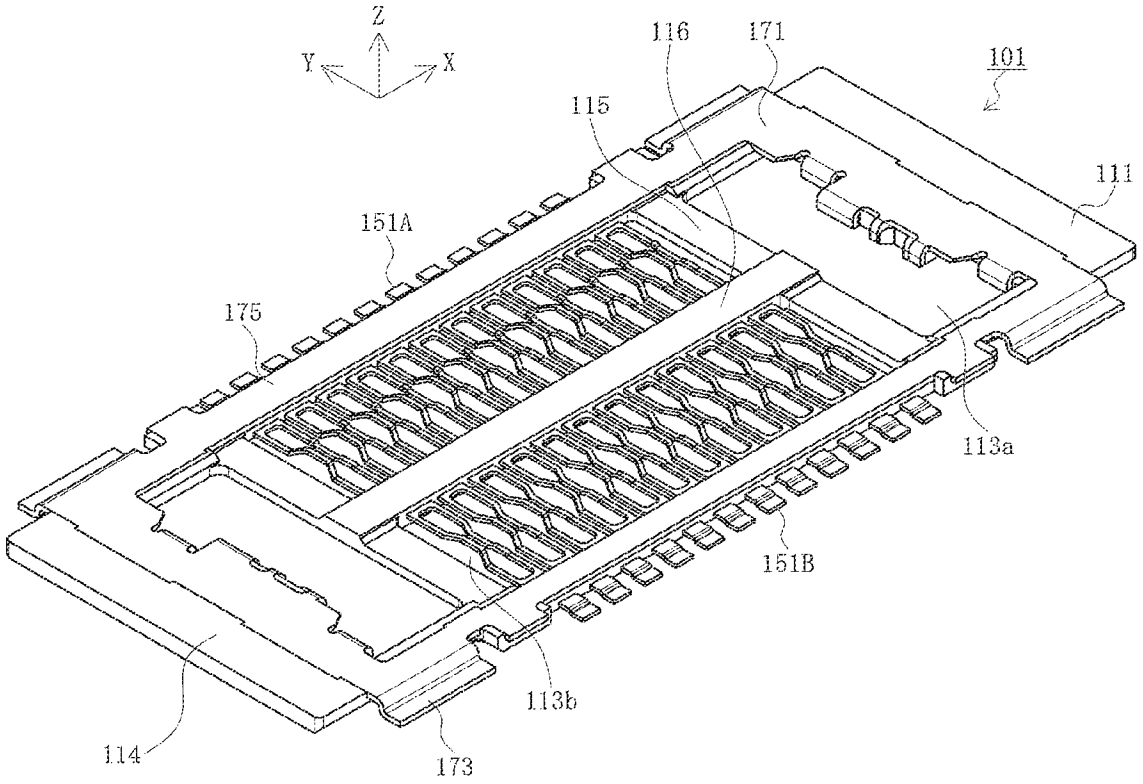
FIG. 7 is a perspective view of a receptacle connector in this embodiment.
Figure 9:
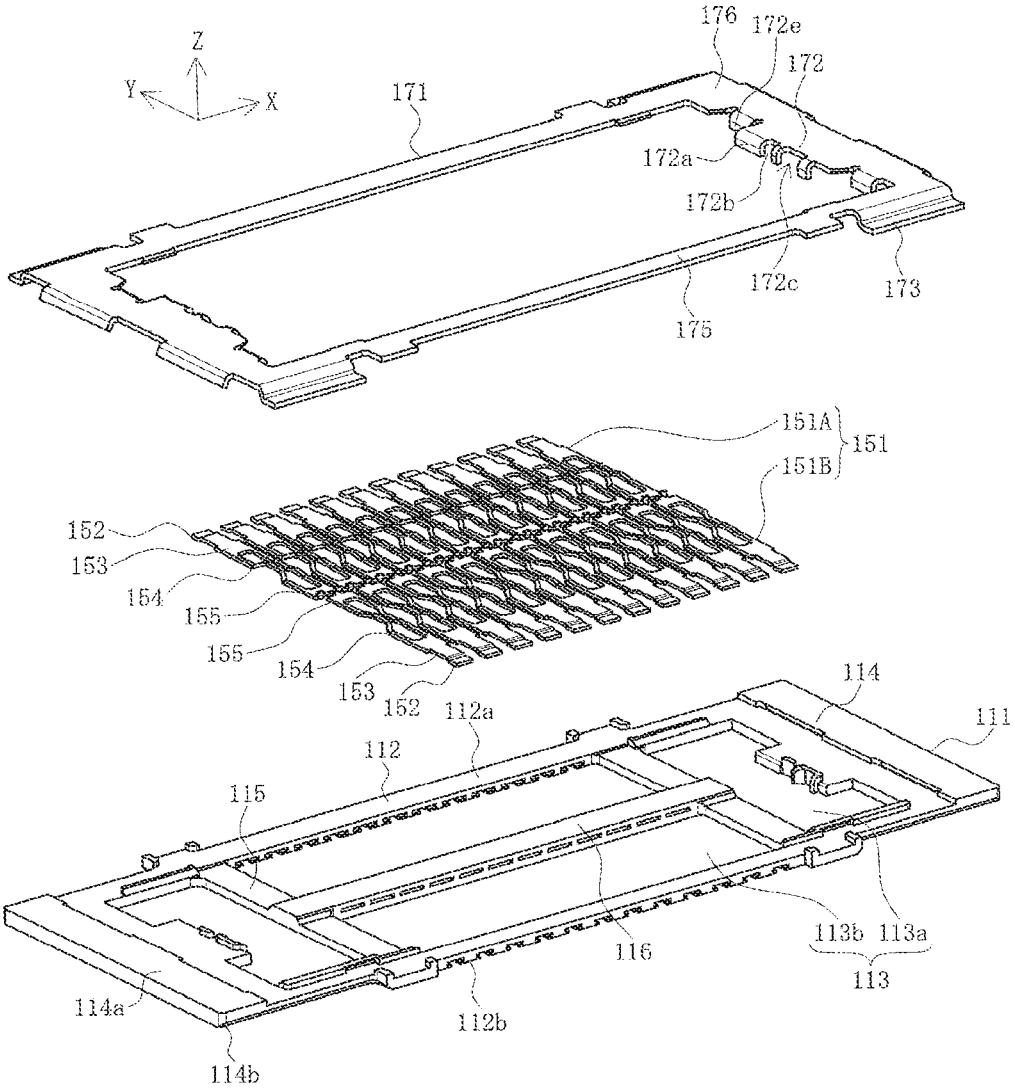
FIG. 9 is an exploded view of the receptacle connector in this embodiment.
Figures 10A, 10B:
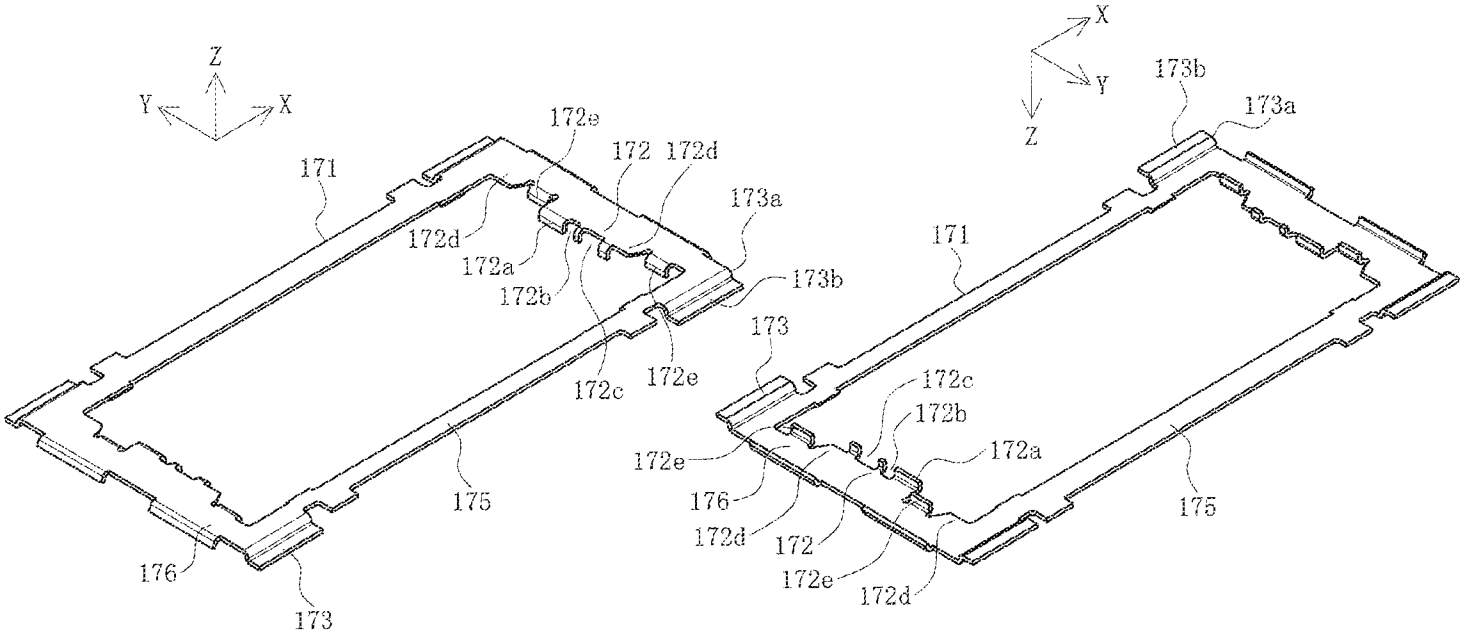
FIGS. 10A and 10B Perspective views of a receptacle shell in this embodiment.
Figure 11A:
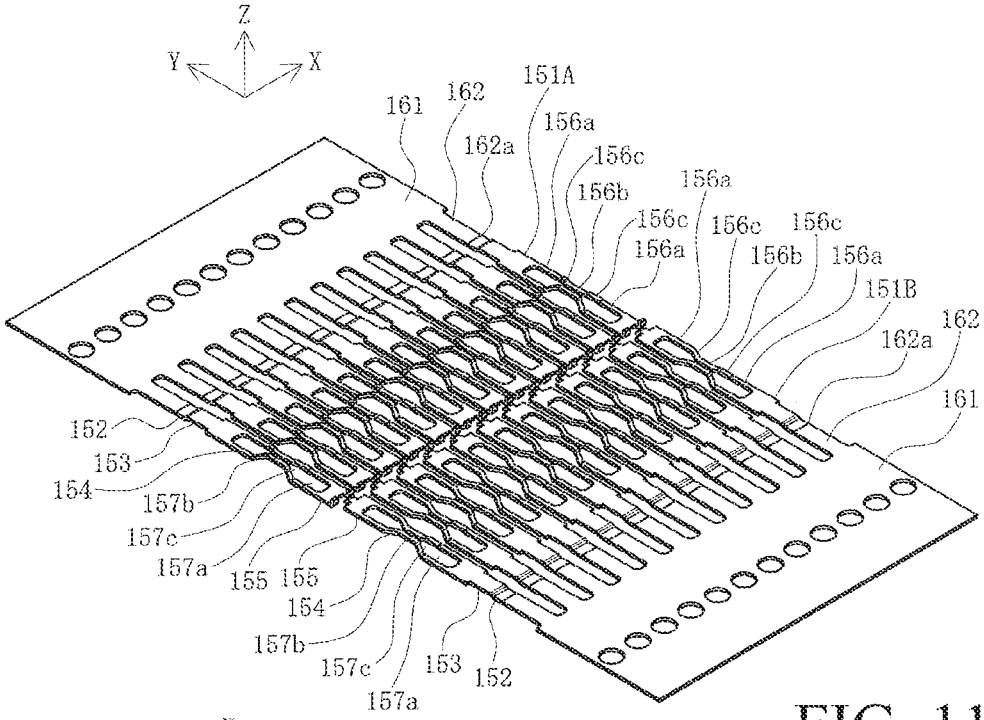
FIGS. 11A and 11B are perspective views of terminals in this embodiment.
Figure 11B:
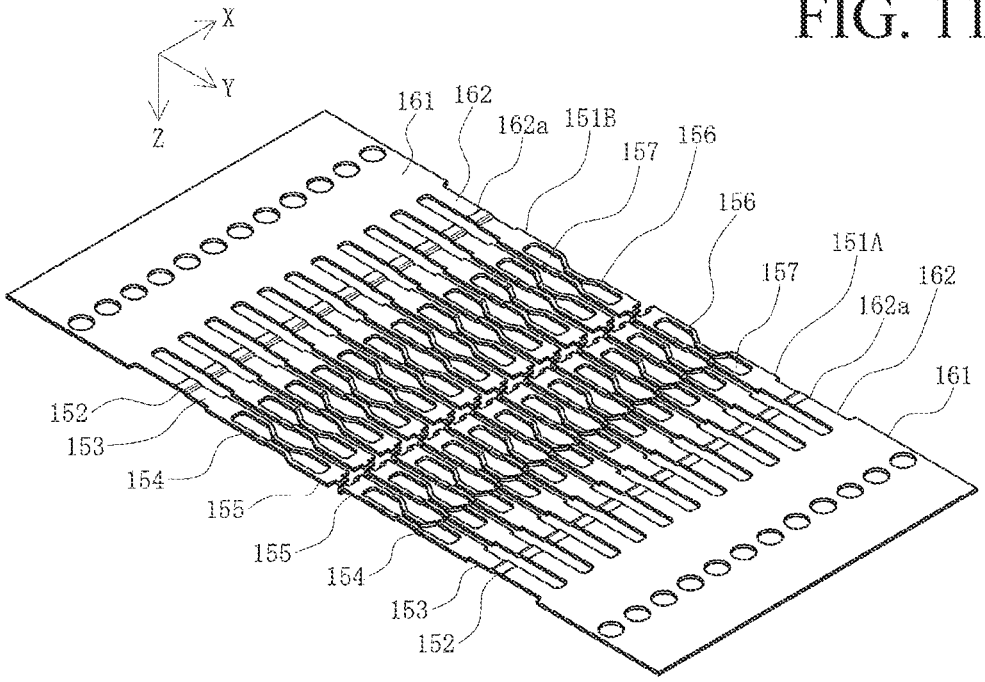
Figure 12A:
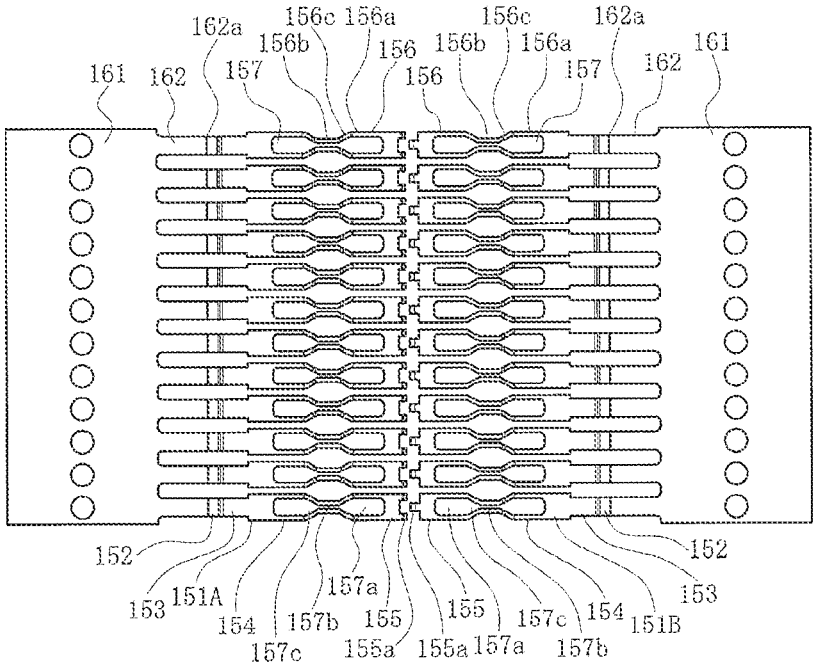
FIGS. 12A to 12C are views of the terminals in this embodiment when viewed from three directions.
Figure 12B:
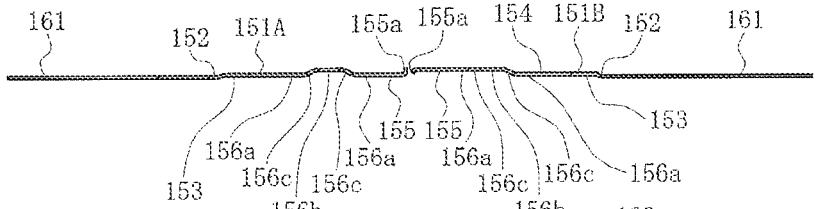
Figure 12C:
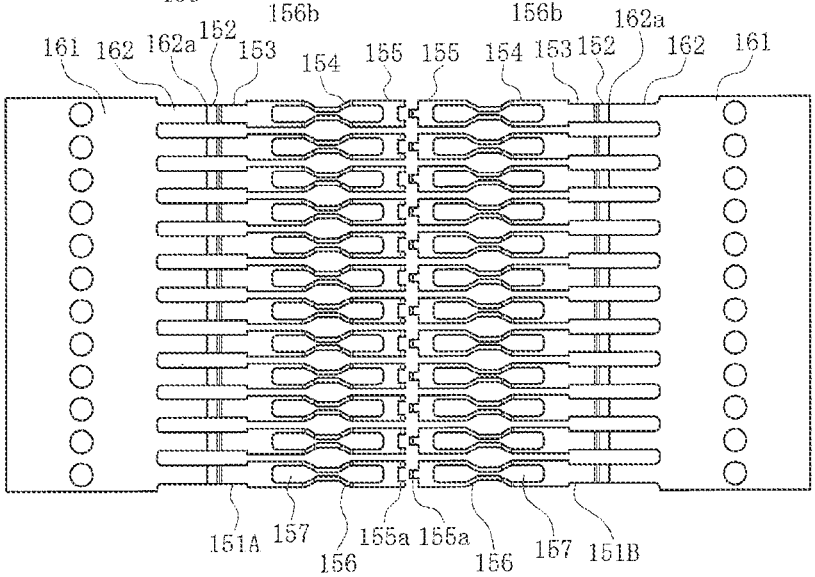

FIG. 7 is a perspective view of the receptacle connector in this embodiment, FIGS. 8A to 8F are views of the receptacle connector in this embodiment when viewed from six directions, FIG. 9 is an exploded view of the receptacle connector in this embodiment, FIGS. 10A and 10B are perspective views of a receptacle shell in this embodiment, FIGS. 11A and 11B are perspective views of terminals in this embodiment, and FIGS. 12A to 12C are views of the terminals in this embodiment when viewed from three directions. FIG. 8A is a top view, FIGS. 8B and 8C are end views, FIGS. 8D and 8E are side views, FIG. 8F is a bottom view, FIG. 10A is a perspective view when viewed from above, FIG. 10B is a perspective view when viewed from below, FIG. 11A is a perspective view of the terminals connected to a carrier when viewed from above, FIG. 11B is a perspective view of the terminals connected to the carrier when viewed from below, FIG. 12A is a top view of the terminals connected to the carrier, FIG. 12B is a side view of the terminals connected to the carrier, and FIG. 12C is a bottom view connected to the carrier.

The receptacle connector 101 includes a housing 111 that is a mating housing made of an insulating material such as resin, terminals 151 that are mating terminals made of a conductive material such as copper alloy, and a receptacle shell 171 that is a mating enforcing fitting made of a metal having a high strength, such as steel. The terminals 151 extend in the longitudinal direction (X-axis direction) of the housing 111 so as to form a plurality of (two in the illustrated example) lines. The housing 111 is a member integrated with the terminals 151 and the receptacle shell 171 by insert-molding and is not present alone. However, in FIG. 9 and other figures, for convenience of description, the housing is drawn as an independent member. As described above, when engaging with the receptacle connector 101, the plug connector 1 may slide with respect to the receptacle connector 101 in the left upward direction (Y-axis positive direction) in FIG. 7.

As illustrated in FIG. 9, the housing 111 is a flat plate-like member having a substantially rectangular flat plane, and includes a pair of lengthwise frame portions 112 that extends in the longitudinal direction, and a pair of outer crosswise frame portions 114 that couple both ends of the lengthwise frame portions 112 to each other and extend in the width direction (Y-axis direction). A substantially rectangular opening 113 defined by the lengthwise frame portions 112 and the outer crosswise frame portions 114 and penetrates in the thickness direction, that is, the vertical direction (Z-axis direction) is formed at the center of the housing. A pair of inner crosswise frame portions 115 that are coupled to the lengthwise frame portions 112 at both ends and extend in the width direction, and a coupling portion 116 that coupled to central parts of the inner crosswise frame portions 115 at both ends and extends in the longitudinal direction to function as a central support portion are disposed in the opening 113. The opening 113 is divided into a pair of lock storage openings 113*a* and a pair of terminal storage openings 113*b* by the inner crosswise frame portions 115 and the coupling portion 116. The lengthwise frame portions 112 and the coupling portion 116 function as mating terminal holding portions.

The terminals 151 include first terminals 151A that are front terminals attached to the lengthwise frame portion 112 on the front side in the slide direction of the plug connector 1 and second terminals 151B that are rear terminals attached to the lengthwise frame portion 112 on the rear side in the slide direction of the plug connector 1. When describing the first terminals 151A and the second terminals 151B together, the first terminals 151A and the second terminals 151B are described as the terminals 151. The terminals 151 each are a member formed of a metal plate bent in the thickness direction, and are produced by punching, bending, or the like of the metal plate, and as illustrated in FIGS. 11A to 12C, the plurality of terminals 151 are connected to a flat plate-like carrier 161. Each of the terminals 151 is connected to the carrier 161 via an elongated connecting arm 162, and is separated from the connecting arm 162 at a cutting portion 162*a* to form a member as illustrated in FIG. 9.

Each of the terminals 151 has a main body 153, a connecting portion 152 that is a tail portion connected to a rear end (end on the side of the carrier 161) of the main body 153, a terminal contact portion 154 that is a contact portion connected to a front end (end away from the carrier 161) of the main body 153, and a tip portion 155 connected to a front end of the terminal contact portion 154. The connecting portion 152 is a conductive portion connected to a connection pad or so on exposed on the surface of the second substrate 191 by use of connection means such as soldering. The terminal contact portion 154 is a conductive portion that is in contact with the signal pin 51 of the plug connector 1. A tip projection 155*a* that is a holding claw protrudes from a tip of the tip portion 155. The first terminal 151A is provided with the two upwardly-curved tip projections 155*a*. The second terminal 151B is provided with the one downwardly-curved tip projection 155*a*.

The terminal contact portion 154 includes a contact opening 157 that is an opening penetrating the terminal contact portion 154 in the thickness direction of the terminal 151, that is, the vertical direction (Z-axis direction), and a pair of elongated opening arm portions 156 defining both sides of the contact opening 157. As illustrated in FIGS. 11A to 12C, the contact opening 157 is an elongated opening extending in the slide direction of the plug connector 1, and includes wide portions 157*a* located at both ends in the longitudinal direction (Y-axis direction), a narrow portions 157*b* located at the center in the longitudinal direction, and the contracted portions 157*c* connected to the wide portions 157*a* on the both longitudinal ends of the narrow portions 157*b*. The contracted portion 157*c* is a portion contracted in width from the wide portion 157*a* to the narrow portion 157*b*. The opening arm portions 156 include wide arm portions 156*a* located on both sides of the wide portion 157*a*, narrow arm portions 156*b* located on both sides of the narrow portion 157*b*, and inclined arm portions 156*c* located on both sides of the contracted portion 157*c*. When the plug connector 1 engages with the receptacle connector 101, the signal contact portion 54 of each signal pin 51 first enters into the rear wide portion 157*a* in the slide direction of the plug connector 1 in the contact opening 157 of the corresponding terminal 151, and when the plug connector 1 slides with respect to the receptacle connector 101, the signal contact portion 54 passes through the contracted portion 157*c* and reaches the narrow portion 157*b*. The width of the wide portion 157*a*, that is, the distance between the opposed wide arm portions 156*a* is larger than the width of the projection 54*c* on the bottom portion 54*b* of the signal contact portion 54, and the width of the narrow portion 157*b*, that is, the distance between the opposed narrow arm portions 156*b* is smaller than the leg portion 54*a* of the signal contact portion 54.

As illustrated in FIG. 12B, in the first terminal 151A, when viewed from side, the main body 153 and the tip portion 155 are planar member and are substantially flush with each other. The wide arm portions 156*a* on the both longitudinal sides of the terminal contact portion 154 are substantially flush with the main body 153 and the tip portion 155, the narrow arm portions 156*b* are substantially parallel to the wide arm portions 156*a*, but are located above the wide arm portions 156*a*, and the inclined arm portions 156*c* are inclined from the wide arm portions 156*a* toward the narrow arm portions 156*b*. When viewing the position of each portion in the height direction (Z-axis direction) along the slide direction of the plug connector 1, the rear wide arm portion 156*a* on the rear side in the slide direction of the plug connector 1, along with the tip portion 155, are located at low level, the inclined arm portion 156*c* on the rear side in the slide direction of the plug connector 1 is upwardly inclined, the narrow arm portions 156*b* are located at high level, the inclined arm portions 156*c* on the front side in the slide direction of the plug connector 1 is downwardly inclined, and the wide arm portion 156*a* on the front side in the slide direction of the plug connector 1, along with the main body 153, are located at low level.

When viewed from side, the main body 153 of the second terminal 151B is a planar member and is substantially flush with the main body 153 of the first terminal 151A, the wide arm portions 156*a* of the terminal contact portion 154 on the rear side in the slide direction of the plug connector 1 is substantially flush with the main body 153, the inclined arm portion 156*c* on the rear side in the slide direction of the plug connector 1 is upwardly inclined from the wide arm portion 156*a* to the narrow arm portion 156*b*, the narrow arm portions 156*b* are substantially parallel to the wide arm portions 156*a* but are located above the wide arm portions 156*a*, and the inclined arm portion 156*c*, the wide arm portion 156*a*, and the tip portion 155 on the front side in the slide direction of the plug connector 1 are substantially flush with the narrow arm portions 156*b*. When viewing the position of each portion in the height direction (Z-axis direction) along the slide direction of the plug connector 1, the wide arm portions 156*a* on the rear side in the slide direction of the plug connector 1, along with the main body 153, is located at low level, the inclined arm portions 156*c* on the rear side in the slide direction of the plug connector 1 is upwardly inclined, the narrow arm portions 156*b* are located at high level, and the inclined arm portions 156*c*, the wide arm portions 156*a*, and the tip portion 155 on the front side in the slide direction of the plug connector 1, along with the narrow arm portions 156*b*, are located at high level. The height of the narrow arm portions 156*b* may be the same as the height of the wide arm portions 156*a*.

Each of the terminal 151 is integrated with the lengthwise frame portion 112 and the coupling portion 116 such that a part of the lower face of the main body 153 is exposed on a lower face 112*b* that is the mounting face (non-engagement face) of the lengthwise frame portion 112, the terminal contact portion 154 is stored in the terminal storage opening 113*b*, and at least a tip of the connecting portion 152 protrudes toward the outer side of the outer end of the lengthwise frame portion 112. Since the first terminal 151A is attached to the lengthwise frame portion 112 and the coupling portion 116 on the front side in the slide direction (Y-axis positive direction), the tip of the connecting portion 152 protrudes further than the end of the lengthwise frame portion 112 on the front side in the slide direction to the front side in the slide direction, and since the second terminal 151B is attached to the lengthwise frame portion 112 and the coupling portion 116 on the rear side in the slide direction (Y-axis negative direction), the tip of the connecting portion 152 protrudes further than the end of the lengthwise frame portion 112 on the rear side in the slide direction to the rear side in the slide direction. The tip portion 155 is integrated with the coupling portion 116, and the upwardly or downwardly-curved tip projection 155*a* penetrates into the coupling portion 116. When viewed in a plan view, the tip projection 155*a* of the first terminal 151A and the tip projection 155*a* of the second terminal 151B are arranged in a staggered manner and are integrated with the coupling portion 116.

The receptacle shell 171 is a flat plate-like frame member produced by punching, bending, or the like of a metal plate having a substantially rectangular planar shape, and as illustrated in FIGS. 9 to 10B, has a pair of lengthwise frame portions 175 that are elongated band-like members extending in the longitudinal direction (X-axis direction) and a pair of crosswise frame portions 176 connected to both ends of the lengthwise frame portions 175. The receptacle shell 171 has a pair of lock receiving portions 172 connected to the inner side of the crosswise frame portions 176 in the longitudinal direction, and substrate connecting portions 173 connected to outer ends of the lengthwise frame portions 175 in the longitudinal direction.

The lock receiving portions 172 each have a contact wall portion 172*a* curved downward from its tip, a main lock receiving portion 172*b* and a temporary lock receiving portion 172*c* that are opened portions formed on the contact wall portion 172*a*, a guide portion 172*e* curved downward on the outer side of the contact wall portion 172*a* in the longitudinal direction (X-axis direction), and a cover portion 172*d* extending inward in the longitudinal direction. The substrate connecting portions 173 each have a crank-like intermediate portion 173*a* connected to the outer end of the lengthwise frame portion 175 when viewed from the side and a flat plate-like connecting plate portion 173*b* connected to a tip of the intermediate portion 173*a*. The connecting plate portion 173*b* is located lower than the lengthwise frame portion 175 and the crosswise frame portion 176.

The receptacle shell 171 is integrated with the housing 111 such that the lengthwise frame portion 175 covers an upper face 112*a* of the lengthwise frame portion 112, an upper face of the crosswise frame portion 176 is exposed on an upper face 114*a* that is an engagement face of the outer crosswise frame portions 114, and the lock receiving portion 172 protrudes into the lock storage opening 113*a*. A lower face of the connecting plate portion 173*b* is substantially flush with the lower face 112*b* and a lower face 114*b* that are mounting faces of the lengthwise frame portion 112 and the outer crosswise frame portion 114.

The operation of engaging the plug connector 1 with the receptacle connector 101 having the above-mentioned configuration will be described next.

Figure 13:
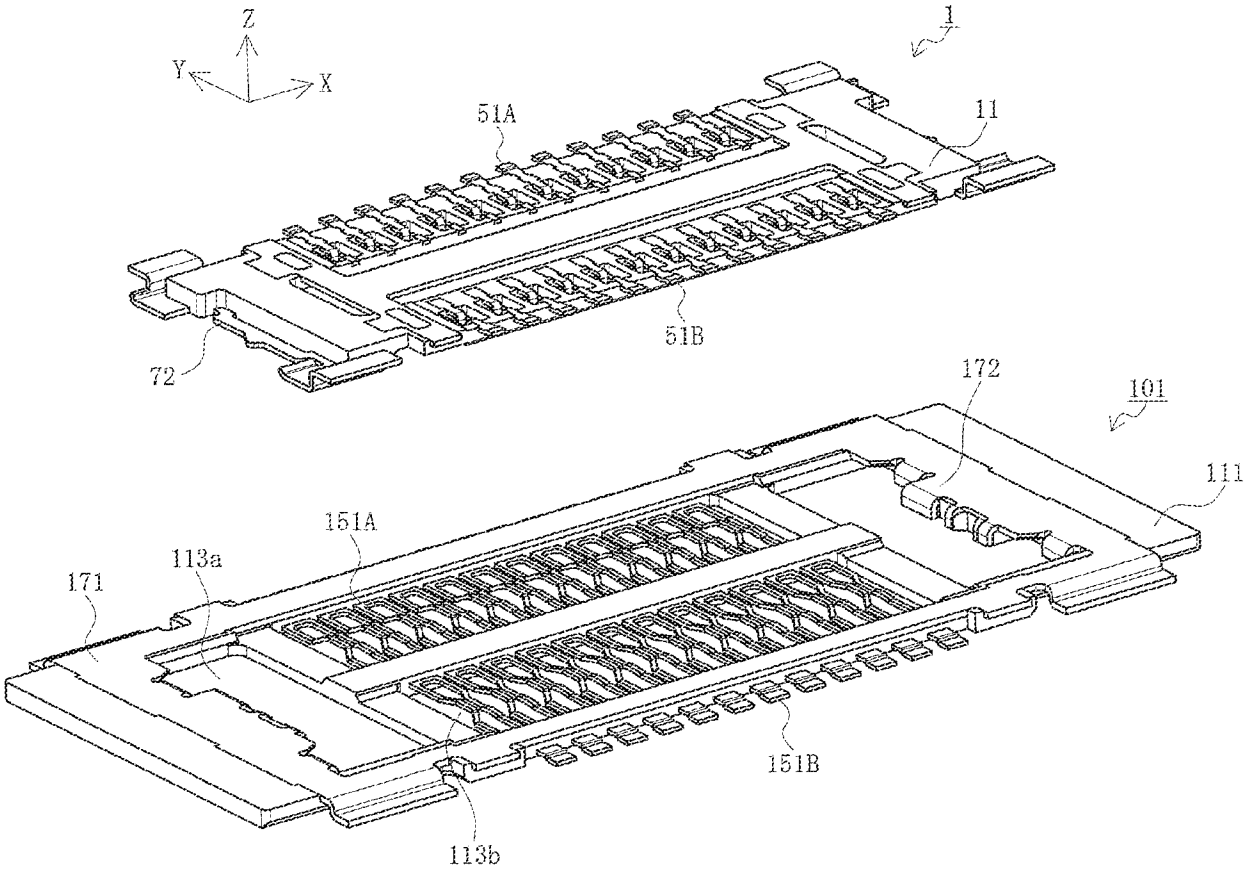
FIG. 13 is a perspective view illustrating the positional relationship between the plug connector and the receptacle connector in a first step of engagement in this embodiment.
Figure 14:
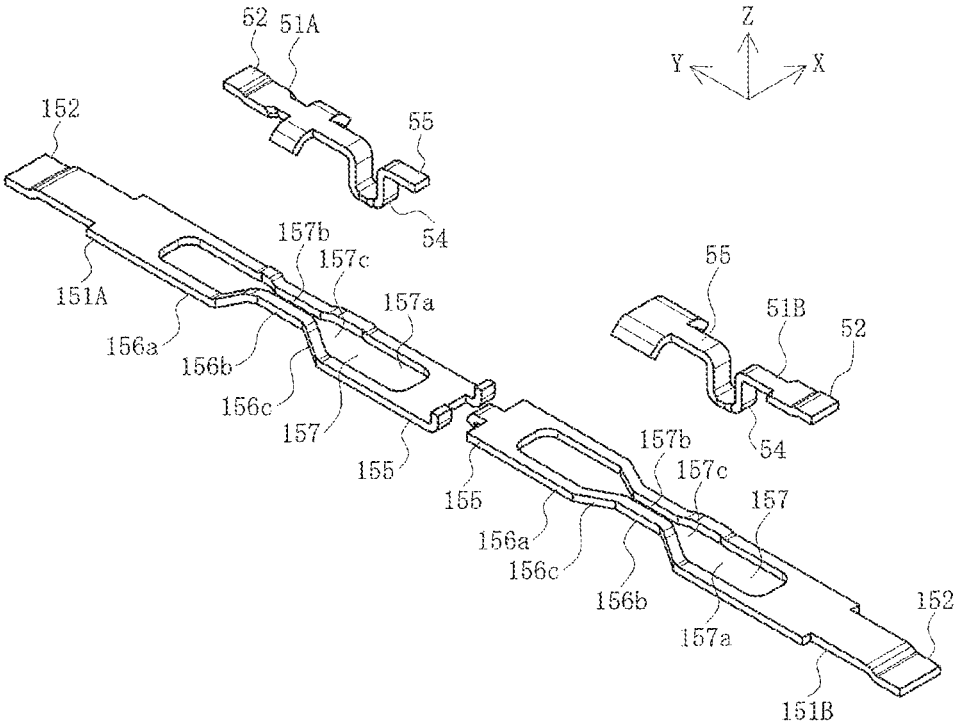
FIG. 14 is a perspective view illustrating the positional relationship between the signal pin and the terminal in the first step of engagement in this embodiment.
Figure 15A:
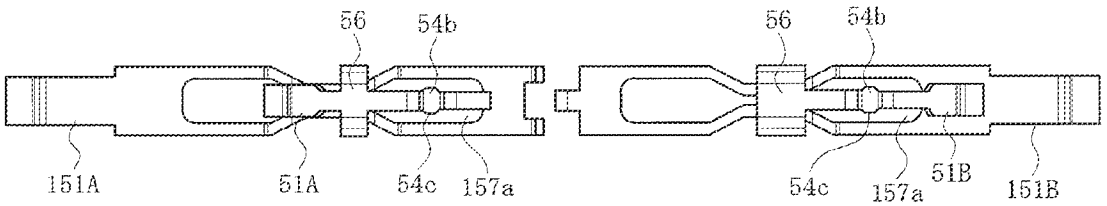
FIGS. 15A and 15C are views illustrating the positional relationship between the signal pin and the terminal in the first step of engagement in this embodiment when viewed from three directions.
Figure 15B:
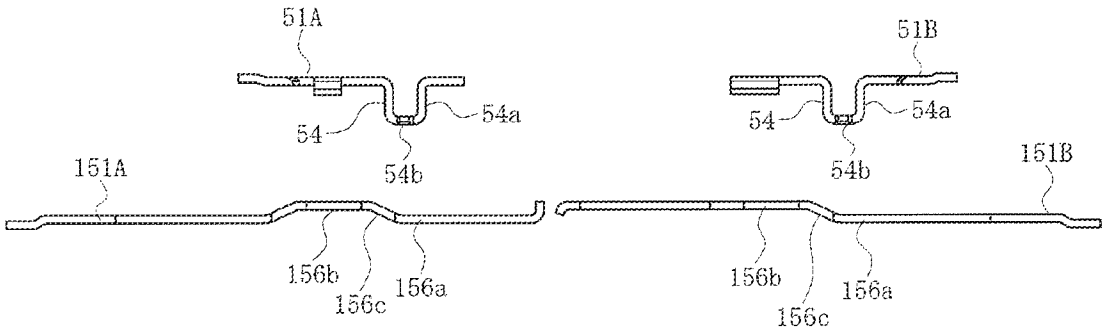
FIG. 15B is a side view.
Figure 15C:
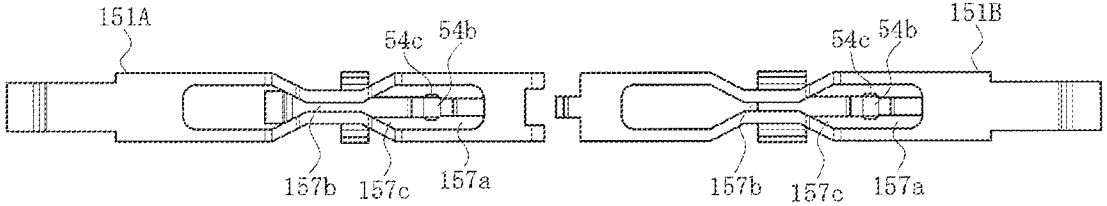
Figure 16:
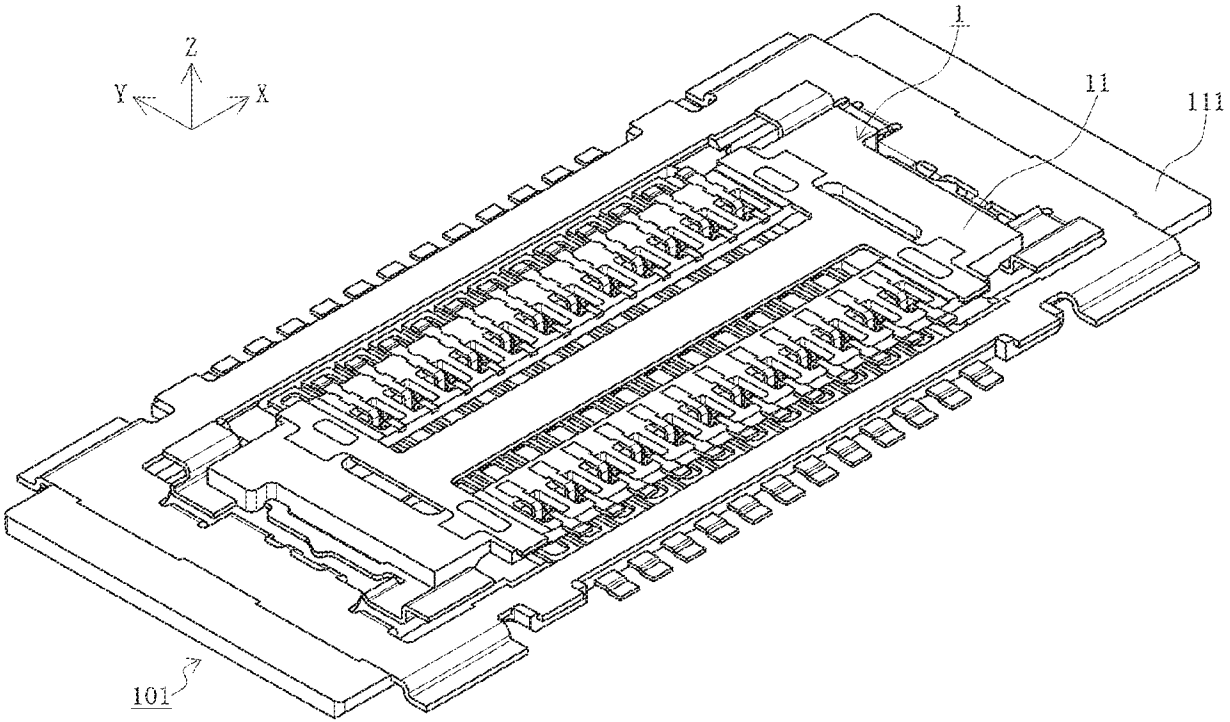
FIG. 16 is a perspective view illustrating the positional relationship between the plug connector and the receptacle connector in a second step of engagement in this embodiment.
Figure 17A:
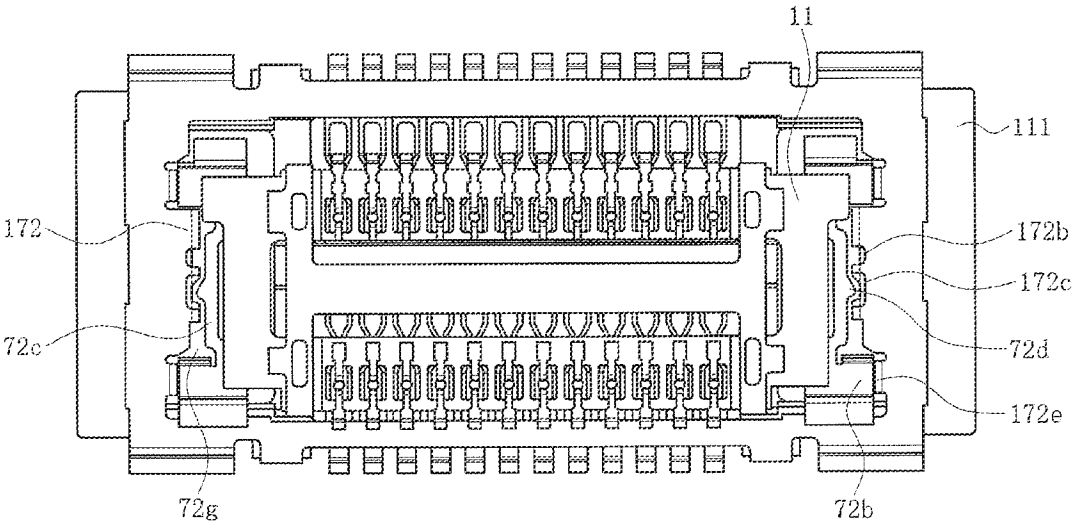
FIGS. 17A and 17B are views illustrating the positional relationship between the plug connector and the receptacle connector in the second step of engagement in this embodiment when viewed from two directions.
Figure 17B:
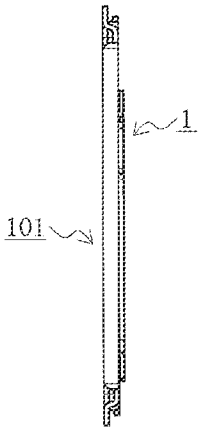
Figure 18:
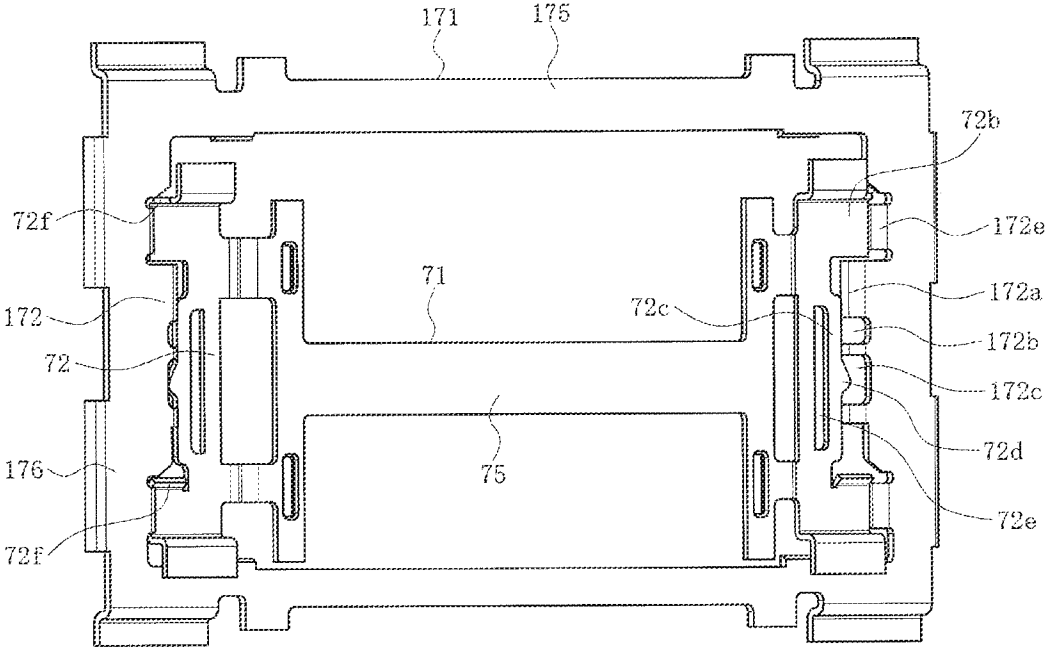
FIG. 18 is a perspective view illustrating the positional relationship between the plug shell and the receptacle shell in the second step of engagement in this embodiment.
Figure 19:
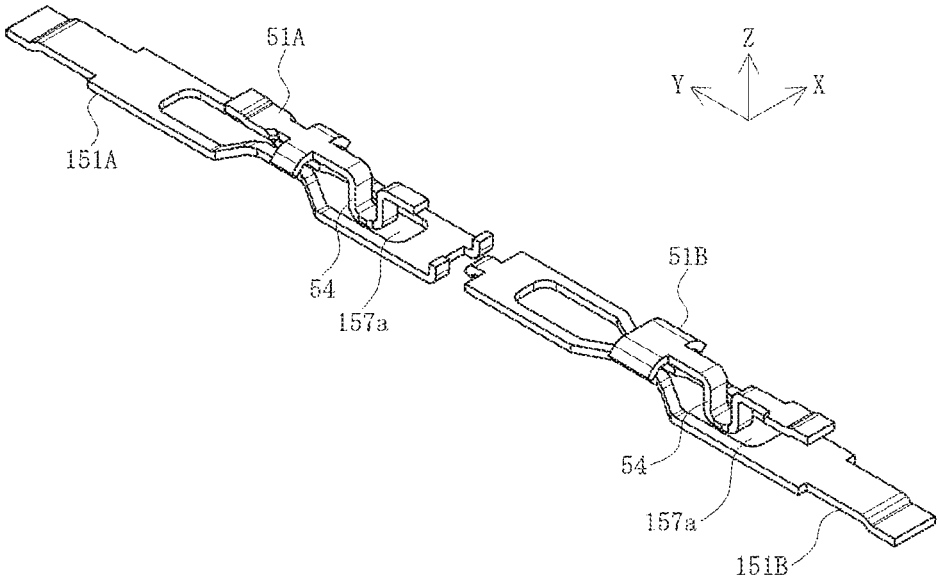
FIG. 19 is a perspective view illustrating the positional relationship between the signal pin and the terminal in the second step of engagement in this embodiment.
Figure 20A:
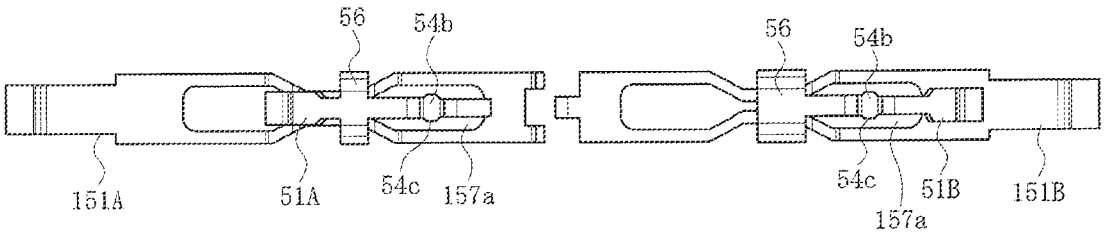
FIGS. 20A to 20C are views illustrating the positional relationship between the signal pin and the terminal in the second step of engagement in this embodiment when viewed from three directions.
Figure 20B:
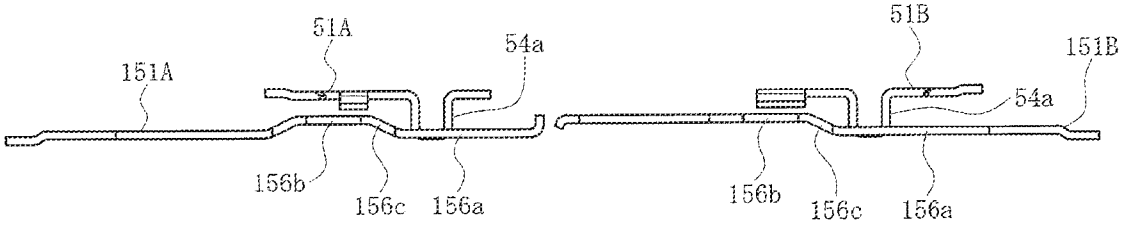
Figure 20C:
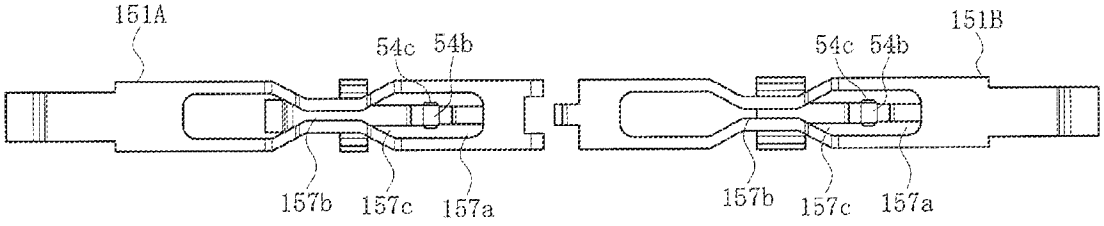
Figure 21:
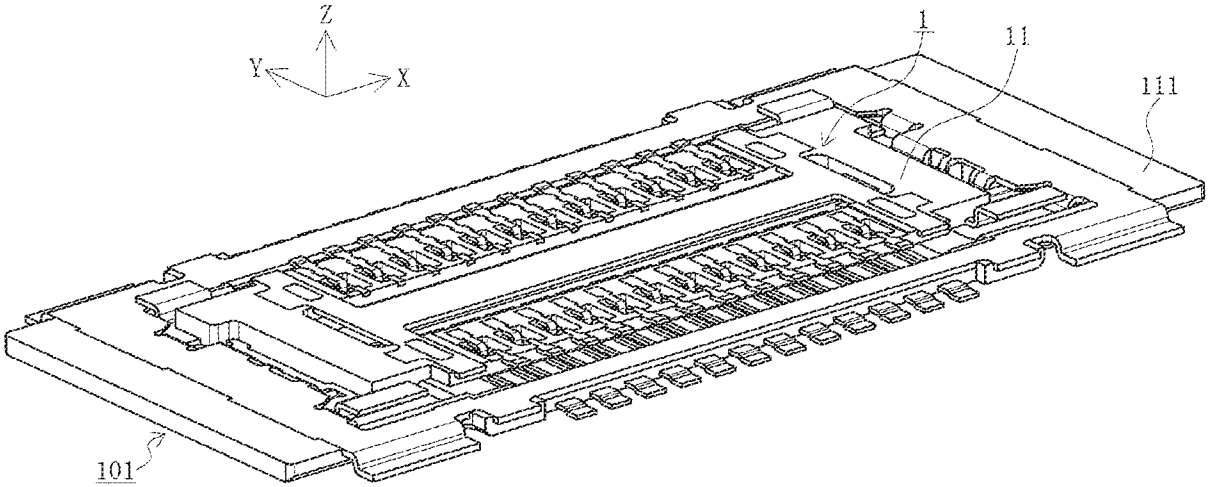
FIG. 21 is a perspective view illustrating the positional relationship between the plug connector and the receptacle connector in a third step of engagement in this embodiment.
Figure 22A:
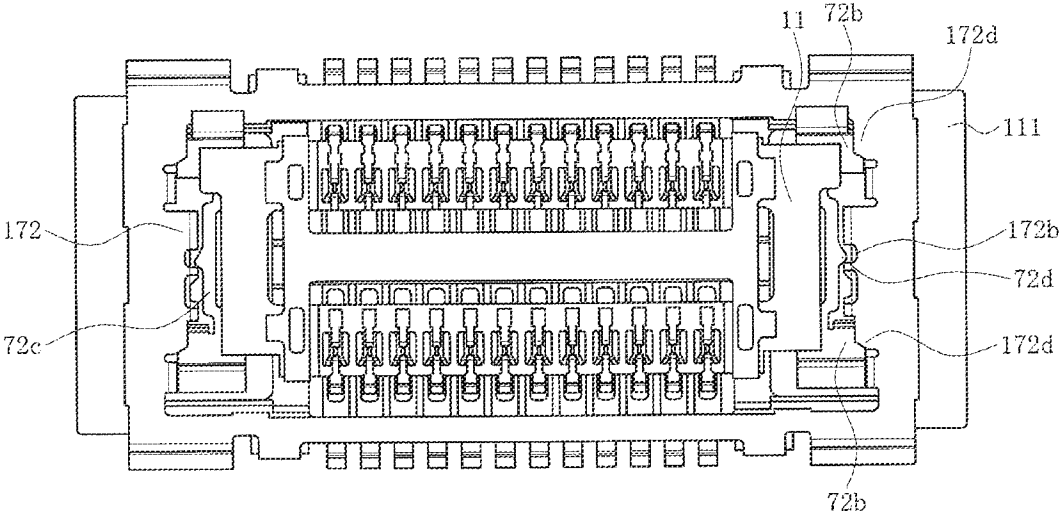
FIGS. 22A and 22B are views illustrating the positional relationship between the plug connector and the receptacle connector in the third step of engagement in this embodiment when viewed from two directions.
Figure 22B:
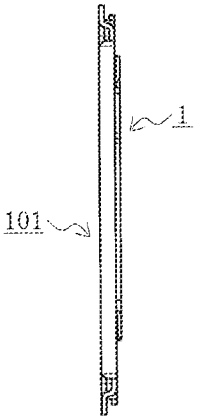
Figure 23:
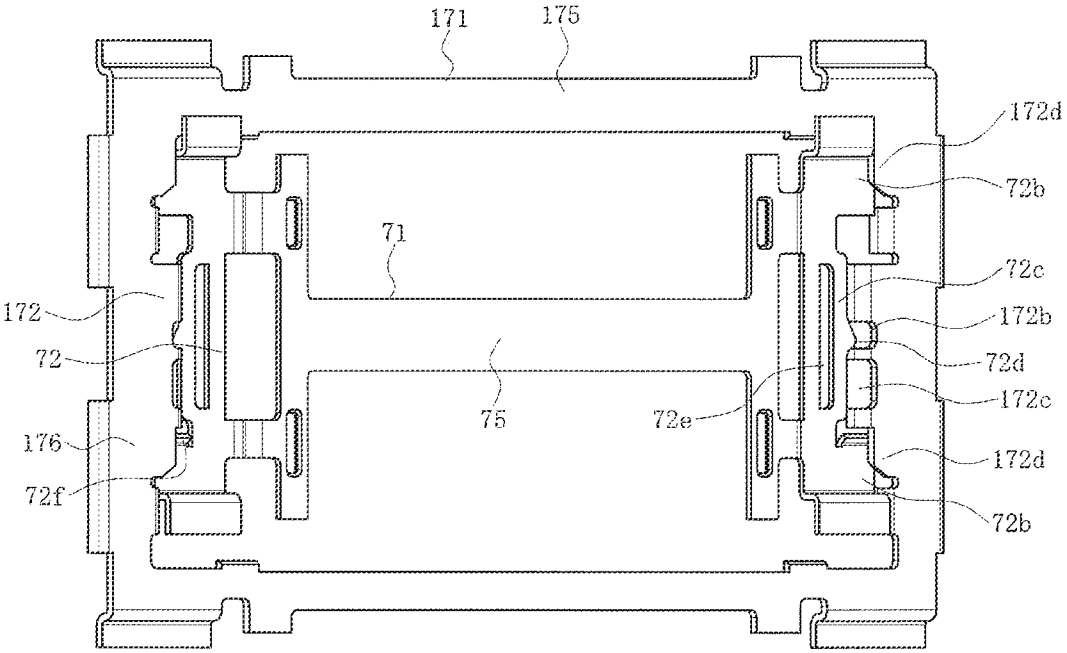
FIG. 23 is a perspective view illustrating the positional relationship between the plug shell and the receptacle shell in the third step of engagement in this embodiment.
Figure 24:
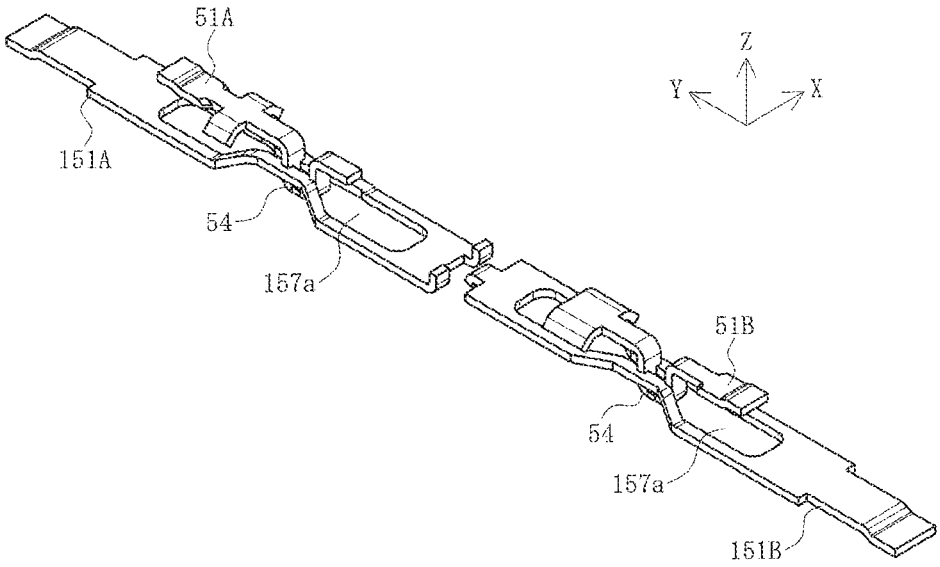
FIG. 24 is a perspective view illustrating the positional relationship between the signal pin and the terminal in the third step of engagement in this embodiment.
Figure 25A:
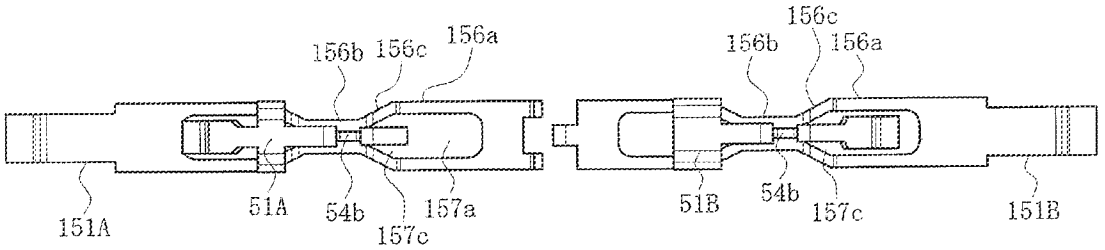
FIGS. 25A to 25C are views illustrating the positional relationship between the signal pin and the terminal in the third step of engagement in this embodiment when viewed from three directions.
Figure 25B:
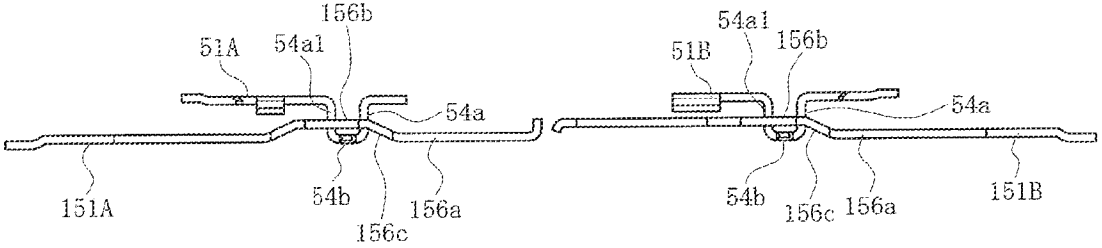
Figure 25C:
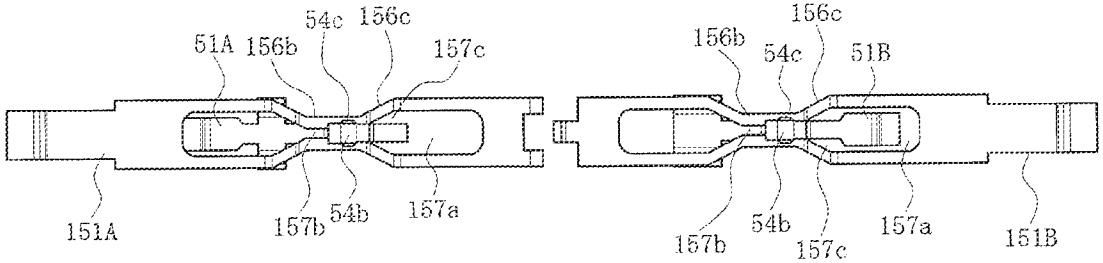
Figure 26A:
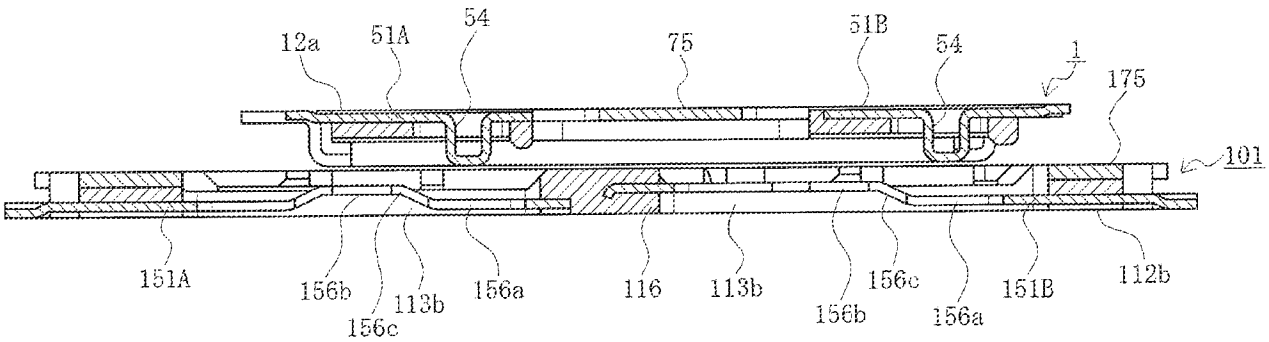
FIGS. 26A to 26C are cross-sectional views illustrating the positional relationship between the signal pin and the terminal in the first to third steps of engagement in this embodiment.
Figure 26B:
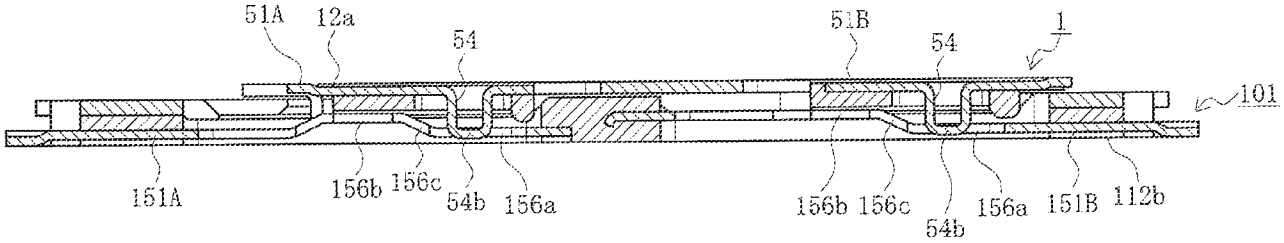
Figure 26C:
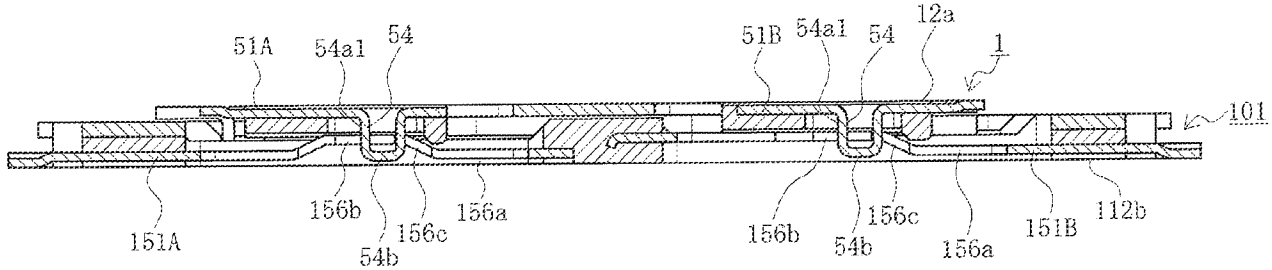
Figure 27A:
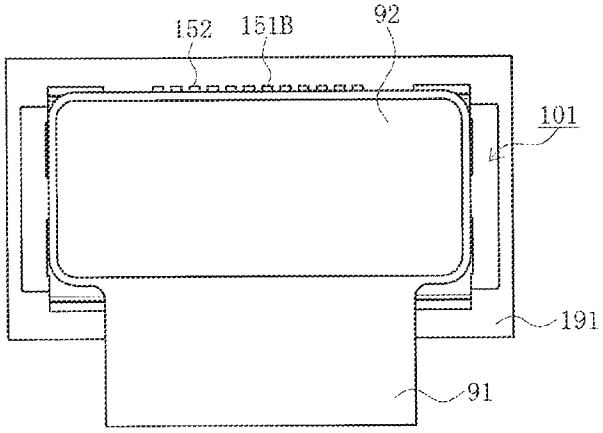
FIGS. 27A to 27D are top views and perspective views illustrating the positional relationship between the plug connector mounted on a first substrate and the receptacle connector mounted on a second substrate in the second and third steps of engagement in this embodiment.
Figure 27B:
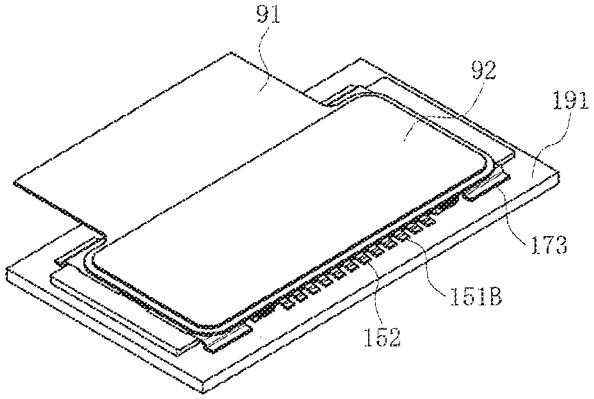
Figure 27C:
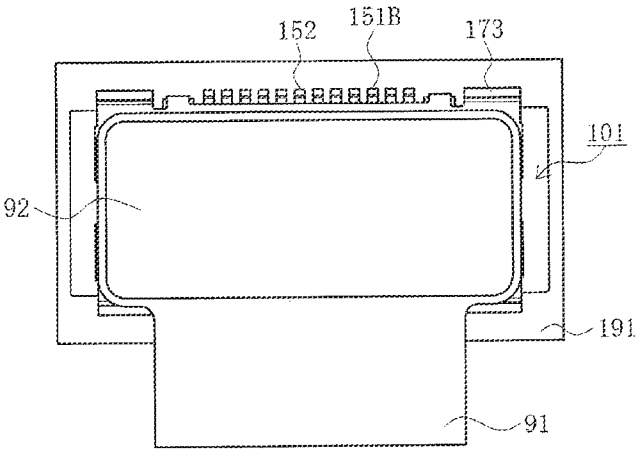
Figure 27D:
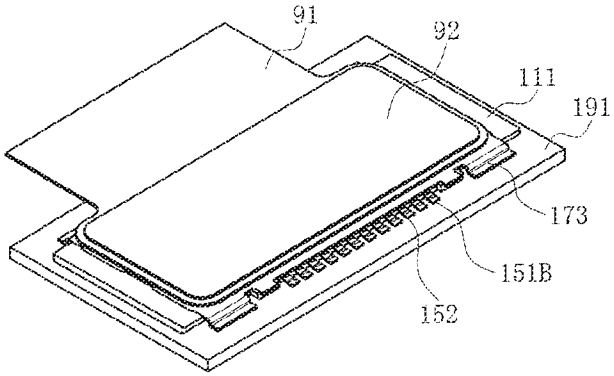
Figure 28A:
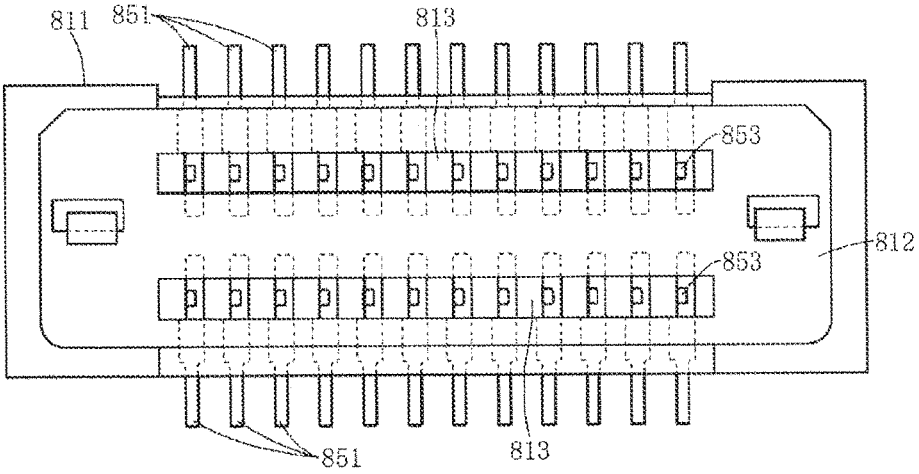
FIG. 28A Prior Art
FIGS. 28A and 28B are views of a known connector when viewed from two directions.
Figure 28B:
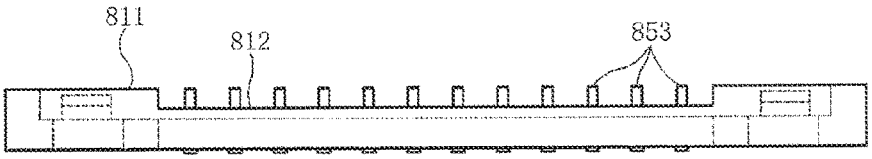
FIG. 28B Prior Art

FIG. 13 is a perspective view illustrating the positional relationship between the plug connector and the receptacle connector in a first step of engagement in this embodiment, FIG. 14 is a perspective view illustrating the positional relationship between the signal pin and the terminal in the first step of engagement in this embodiment, FIGS. 15A and 15C are views illustrating the positional relationship between the signal pin and the terminal in the first step of engagement in this embodiment when viewed from three directions, FIG. 16 is a perspective view illustrating the positional relationship between the plug connector and the receptacle connector in a second step of engagement in this embodiment, FIGS. 17A and 17B are views illustrating the positional relationship between the plug connector and the receptacle connector in the second step of engagement in this embodiment when viewed from two directions, FIG. 18 is a perspective view illustrating the positional relationship between the plug shell and the receptacle shell in the second step of engagement in this embodiment, FIG. 19 is a perspective view illustrating the positional relationship between the signal pin and the terminal in the second step of engagement in this embodiment, FIGS. 20A to 20C are views illustrating the positional relationship between the signal pin and the terminal in the second step of engagement in this embodiment when viewed from three directions, FIG. 21 is a perspective view illustrating the positional relationship between the plug connector and the receptacle connector in a third step of engagement in this embodiment, FIGS. 22A and 22B are views illustrating the positional relationship between the plug connector and the receptacle connector in the third step of engagement in this embodiment when viewed from two directions, FIG. 23 is a perspective view the positional relationship between the plug shell and the receptacle shell in the third step of engagement in this embodiment, FIG. 24 is a perspective view illustrating the positional relationship between the signal pin and the terminal in the third step of engagement in this embodiment, FIGS. 25A to 25C are views illustrating the positional relationship between the signal pin and the terminal in the third step of engagement in this embodiment when viewed from three directions, FIGS. 26A and 26C are sectional views illustrating the positional relationship between the signal pin and the terminal in the first to third steps of engagement in this embodiment, FIGS. 27A to 27D are top views and perspective views illustrating the positional relationship between the plug connector mounted in a first substrate and the receptacle connector mounted on a second substrate in the second and third steps of engagement in this embodiment. Note that FIG. 15A, FIG. 20A, FIG. 25A are top views, FIG. 15B, FIG. 20B, FIG. 25B are side views, and FIG. 15C, FIG. 20C, FIG. 25C are bottom views, FIG. 17A and FIG. 22A are top views, FIG. 17B and FIG. 22B are end views, FIGS. 26A to 26C are views illustrating the first to third steps of engagement, FIG. 27A is a top view illustrating the second step of engagement, FIG. 27B is a perspective view illustrating the second step of engagement, FIG. 27C is a top view illustrating the third step of engagement, and FIG. 27D is a perspective view illustrating the third step of engagement.

Here, the plug connector 1 is previously mounted on the surface of the first substrate 91 by connecting the connecting portion 52 of the signal pin 51 to a connection pad formed on the surface of the first substrate 91 by soldering, etc., and connecting a connecting plate portion 73*b* of the plug shell 71 to a fixing pad formed on the first substrate 91 by soldering, etc. In the example illustrated in FIGS. 27A to 27D, the first substrate 91 is a flexible flat cable, and the plug connector 1 is mounted on a lower face of a tip of the flexible flat cable. In FIGS. 27A to 27D, 92 denotes an enforcing layer for enforcing the tip of the flexible flat cable. The receptacle connector 101 is previously mounted on the second substrate 191 by connecting the connecting portion 152 of the terminal 151 to a connecting pad not illustrated formed on the surface of the second substrate 191 by means of soldering or the like, and connecting a connecting plate portion 173*b* of the receptacle shell 171 to a fixing pad not illustrated formed on the surface of the second substrate 191 by means of soldering or the like. In the example illustrated in FIGS. 27A to 27D, the second substrate 191 is a printed circuit board, and the receptacle connector 101 is mounted on the upper face of the printed circuit board. In FIGS. 13 to 26C, for convenience of description, the first substrate 91 and the second substrate 191 are not illustrated.

First, in a first step of engagement, as illustrated in FIG. 13, the operator puts the lower face that is the engagement face of the plug connector 1 and the upper face that is the engagement face of the receptacle connector 101 into the state where they are opposed to each other. Specifically, the first signal pins 51A and the second signal pins 51B are opposed to the first terminals 151A and the second terminals 151B, respectively, and the crosswise frame portions 14 and the lock portions 72 are opposed to the lock storage openings 113*a*.

At this time, the positional relationship between each signal pin 51 and the corresponding terminal 151 is put into the state as illustrated in FIGS. 14 to 15C. That is, the signal contact portion 54 of each signal pin 51 is opposed to the rear wide portion 157*a* of the contact opening 157 of the corresponding terminal 151 in the slide direction of the plug connector 1.

Next, in a second step of engagement, the operator lowers the plug connector 1 with respect to the receptacle connector 101 and as illustrated in FIG. 26A, makes the plug connector 1 closer to the receptacle connector 101 and then, as illustrated in FIGS. 16 to 17B, put the lower face of the plug connector 1 into contact with or close to the upper face of the receptacle connector 101.

Then, the positional relationship between each signal pin 51 and the corresponding terminal 151 is put into the state as illustrated in FIGS. 19, 20A to 20C, and 26B. That is, the signal contact portion 54 of each signal pin 51 enters into the rear wide portion 157*a* of the contact opening 157 of the corresponding terminal 151 in the slide direction of the plug connector 1. At this time, since the width of the wide portion 157*a*, that is, the distance between the opposed wide arm portions 156*a* is set larger than the width of the projection 54*c* on the bottom portion 54*b* of the signal contact portion 54, the signal contact portion 54 may smoothly enter into the contact opening 157. Since the wide portion 157*a* and the wide arm portion 156*a* on the rear side in the slide direction in the plug connector 1 are located at low level, the bottom portion 54*b* of the signal contact portion 54 do not largely protrude below the wide arm portions 156*a*.

The positional relationship between each lock portion 72 and the corresponding each lock receiving portion 172 is put into the state as illustrated in FIGS. 17A to 18. That is, the contact wall portion 172*a* is stored in the concave space 72*g*, the lock spring piece 72*c* makes contact with or comes close to the contact wall portion 172*a*, the lock projection 72*d* enters and engages with the temporary lock receiving portion 172*c*, and the pair of arm portions 72*b* make contact with or come close to the respective guide portion 172*e*. Thereby, the lock portions 72 and the lock receiving portions 172 are temporarily locked such that the plug connector 1 and the receptacle connector 101 are temporarily locked.

Next, in a third step of engagement, the operator slides the plug connector 1 with respect to the receptacle connector 101 in the Y-axis positive direction to complete engagement as illustrated in FIGS. 21 to 22B.

Then, the positional relationship between each signal pin 51 and the corresponding terminal 151 is put into the state as illustrated in FIGS. 24, 25A to 25C, and 26C. That is, the signal contact portion 54 of each signal pin 51 enters into the narrow portion 157*b* of the contact opening 157 of the corresponding terminal 151. Since the narrow portion 157*b* and the narrow arm portion 156*b* are located at low level, the bottom portion 54*b* of the signal contact portion 54 protrudes below the narrow arm portions 156*b*, and the leg portion 54*a* enters into the narrow portion 157*b*, that is, between the opposed narrow arm portions 156*b*. In addition, the bottom portion 54*b* does not protrude downward to reach the lower face 112*b* of the lengthwise frame portion 112, which is the mounting face of the receptacle connector 101 and thus, does not contact the surface (upper face) of the second substrate 191.

Since the width of the narrow portion 157*b*, that is, the distance between the opposed narrow arm portions 156*b* is set smaller than the width of the leg portion 54*a*, the leg portion 54*a* enters, thereby increasing the distance between the narrow arm portions 156*b* to elastically deform the opening arm portions 156. In this manner, the opening arm portions 156 exerts a spring force and the leg portion 54*a* is clamped between the narrow arm portions 156*b*, to reliably keep contact of the leg portion 54*a* and the narrow arm portions 156*b*, thereby reliably electrically connecting the signal pin 51 to the terminal 151. In more detail, since the wide main contact portion 54*a*1 of the leg portion 54*a* is reliably clamped between the narrow arm portions 156*b*, the signal pin 51 is electrically connected to the terminal 151 with stability, preventing failure of electrical connection. Since the contracted portion 157*c* is present between the wide portion 157*a* and the narrow arm portion 156*b* and gradually narrows from the wide portion 157*a* to the narrow portion 157*b*, the signal contact portion 54 may smoothly enters into the narrow portion 157*b*.

The projection 54*c* further protruding outward than the width of the bottom portion 54*b* is formed on the bottom portion 54*b* protruding below the narrow arm portion 156*b*, and the width of the leg portion 54*a*, and the distance between the narrow arm portions 156*b* extended by the leg portion 54*a* is set sufficiently larger than the width of the projection 54*c* on the bottom portion 54*b*. Thus, even when an external force to release engagement (in the Z-axis positive direction) is applied to the plug connector 1, the signal contact portion 54 does not displace in the Z-axis positive direction to escape from the narrow arm portions 156*b*.

The positional relationship between each lock portion 72 and the corresponding lock receiving portion 172 is put into the state as illustrated in FIGS. 22A to 23. That is, the lock spring piece 72*c* makes contact with or comes closer to the contact wall portion 172*a*, the lock projection 72*d* is disposed from the temporary lock receiving portion 172*c* to between the temporary lock receiving portion 172*c* and the main lock receiving portion 172*b*, gets over the downwardly-extending intermediate piece, moves to and engages with the main lock receiving portion 172*b*, and the pair of arm portions 72*b* proceed below the respective cover portions 172*d* and engage therewith. At this time, since the coupling portions 75 perform the bridging function, the plug shell 71 does not deform and the lock projection 72*d* reliably engages with the main lock receiving portion 172*b*. In this case, the lock spring piece 72*c* provided with the lock projection 72*d* is a double-supported beam. Thus, it has a high strength, and does not break. Since the curved portion 72*f* is formed at the end of the arm portion 72*b* on the front side in the slide direction, even when an external force in the non-engaging direction (Z-axis positive direction) is applied to the plug connector 1, the arm portions 72*b* having a high strength do not deform to release engagement with the cover portion 172*d*. In particular, the curved portion 72*f* of the arm portion 72*b* on the front side in the slide direction is coupled to the intermediate portion 73*a* of the substrate connecting portion 73 and thus, has a higher strength.

As described above, in a second step of engagement, since the pair of arm portions 72*b* is in contact with or is close to the respective guide portions 172*e*, when the plug connector 1 is slid with respect to the receptacle connector 101 to proceed to the third step, the plug connector 1 slides with respect to the receptacle connector 101 in the state where the pair of arm portions 72*b* of each lock portion 72 are guided by the guide portions 172*e*. Accordingly, the plug connector 1 stably slides in the Y-axis positive direction, and is not inclined in the Y-axis positive direction.

Thereby, the lock portions 72 and the lock receiving portions 172 are locked to each other, preventing relative displacement in the Y-axis direction. Accordingly, since the plug connector 1 and the receptacle connector 101 are reliably locked to each other in the engaged state, engagement is not unnecessarily released.

In this embodiment, as the contact opening 157 of the terminal 151, the wide portion 157*a* and the contracted portion 157*c* are formed on both longitudinal sides of the narrow portion 157*b*. However, the wide portion 157*a* and the contracted portion 157*c* on the front side in the slide direction of the plug connector 1 may be modified to an opening having the same width as the narrow portion 157*b*.

As described above, in this embodiment, the plug connector 1 includes the housing 11 and the signal pins 51 held by the housing 11. The housing 11 includes the flat plate-like lengthwise frame portions 12 and the contact portion storage openings 15 opened to the lower faces 12*b* of the lengthwise frame portions 12. The signal pins 51 each has the main body 53, the U-shaped signal contact portion 54 that is connected to the front end of the main body 53 and protrudes downward, and the tip portion 55 connected to the signal contact portion 54. The signal contact portion 54 includes the pair of leg portions 54*a* extending downward and the bottom portion 54*b* coupling the lower ends of the leg portions 54*a* to each other. The main body 53 and the tip portion 55 are integrally connected to and held by the lengthwise frame portions 12. The signal contact portion 54 is stored in the contact portion storage opening 15, and the bottom portion 54*b* protrudes below the lower face 12*b* of the lengthwise frame portion 12.

The signal pin 51 is formed of a metal plate bent in the thickness direction of the plate. The bottom portion 54*b* includes projections 54*c* protruding from both left and right sides outward in the width direction. The leg portions 54*a* of the signal pin 51 contact the terminal 151. One leg portion 54*a* in the pair is wider the other leg portion 54*a* to form the main contact portion 54*a*1. The wide portion 56 is formed at either the main body 53 or the tip portion 55 that is closer to the main contact portion 54*a*1. The plug connector further includes the plug shell 71 held by the housing 11, and the housing 11 includes the pair of crosswise frame portions 14 coupling the both longitudinal ends of the pair of lengthwise frame portions 12 to each other. The plug shell 71 includes the pair of lock portions 72, and at least a part of the lock portion 72 protrudes outward from the crosswise frame portion 14.

In this manner, the size of the plug connector 1 in the thickness direction (Z-axis direction) can be decreased to reliably hold and position of the signal pins 51. The signal pin 51 can reliably engage with the terminal 151 to reliably keep contact between the signal pin 51 and the terminal 151, thereby reliably keeping engagement of the plug connector 1 with the receptacle connector 101. Such connectors can be easily produced with simple and compact configuration at low costs while improving reliability.

Note that the present disclosure is only one example, and thus any appropriate change that preserves the gist of the present disclosure and can easily be conceived by a person skilled in the art falls within the scope of the present disclosure. The widths, thicknesses, and shapes of the portions illustrated in the drawing are illustrated schematically and are not intended to limit the interpretation of the present disclosure.

The disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to a connector, a mating connector, and a connector assembly.

The invention claimed is:

1. A connector comprising:

a housing; and a terminal held by the housing, wherein the housing includes:

a flat plate-like terminal holding portion; and a contact portion storage opening opened in a lower face of the terminal holding portion, wherein the terminal includes:

a main body;

a U-shaped contact portion connected to a front end of the main body, the U-shaped contact portion protruding downward; and a tip portion connected to a front end of the U-shaped contact portion, the U-shaped contact portion including a pair of leg portions extending downward and a bottom portion coupling lower ends of the leg portions to each other, wherein the main body and the tip portion are integrally connected to the terminal holding portion and held by the terminal holding portion, and wherein the U-shaped contact portion is stored in the contact portion storage opening.

2. The connector according to claim 1, wherein the terminal is formed of a metal plate bent in a thickness direction.

3. The connector according to claim 1, wherein the leg portions of the terminal are configured to make contact with a mating terminal.

4. The connector according to claim 3, wherein one leg portion in the pair is wider than the other leg portion to form a main contact portion.

5. The connector according to claim 1, wherein the bottom portion include engagement projections protruding from both left and right sides outward in a width direction.

6. The connector according to claim 1, wherein the bottom portion protrudes below a lower face of the terminal holding portion.

7. A mating connector that is engageable with the connector according to claim 1, the mating connector comprising:

a mating housing; and a mating terminal held by the mating housing, wherein the mating housing includes:

a flat plate-like mating terminal holding portion; and a terminal storage opening, the mating terminal includes:

a main body, a contact portion connected to a front end of the main body, the contact portion having a contact opening penetrating the mating terminal in a thickness direction; and a tip portion connected to a front end of the contact portion, the main body and the tip portion are integrally connected to the mating terminal holding portion and held by the mating terminal holding portion, the contact portion being stored in the terminal storage opening, and when the mating connector engages with the connector, a pair of opening arm portions located at both sides of the contact opening clamp the leg portions.

8. A connector assembly comprising:

the connector according to claim 1; and a mating connector that is engageable with the connector.

* * * * *